US006807888B1

(12) United States Patent
Kiyohara et al.

(10) Patent No.: US 6,807,888 B1
(45) Date of Patent: Oct. 26, 2004

(54) RECORDING MATERIAL CUTTING DEVICE

(75) Inventors: Naoki Kiyohara, Mitaka (JP); Yousuke Tatsumi, Mitaka (JP); Kazutaka Miyamoto, Mitaka (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 09/959,865

(22) PCT Filed: May 15, 2000

(86) PCT No.: PCT/JP00/03108

§ 371 (c)(1),
(2), (4) Date: Nov. 9, 2001

(87) PCT Pub. No.: WO00/69605

PCT Pub. Date: Nov. 23, 2000

(30) Foreign Application Priority Data

May 13, 1999 (JP) ..... 11/133353
Jun. 17, 1999 (JP) ..... 11/171616

(51) Int. Cl.[7] ..... B41J 15/02; B41J 2/22

(52) U.S. Cl. ..... 83/485; 83/614; 400/621; 346/24

(58) Field of Search ..... 83/614, 485, 358, 83/477.2, 487, 508, 469, 483, 582, 484, 563, 578, 583; 400/593, 621, 621.2, 621.1; 346/46, 29, 49, 24, 141

(56) References Cited

U.S. PATENT DOCUMENTS 4,098,155 A * 7/1978 Insolio ..... 83/884
4,152,962 A * 5/1979 Hendrischk ..... 83/482
4,525,088 A * 6/1985 Shipos et al. ..... 400/621
4,701,063 A * 10/1987 Wysk et al. ..... 400/621
5,243,890 A * 9/1993 Ober ..... 83/471.2
5,272,947 A * 12/1993 Peters ..... 83/455
5,296,872 A * 3/1994 Caamano ..... 346/24
5,363,123 A * 11/1994 Petersen et al. ..... 346/24
5,436,646 A * 7/1995 Schilling et al. ..... 346/139 R
5,787,778 A * 8/1998 Saito et al. ..... 83/383
6,302,602 B1 * 10/2001 Kiyohara et al. ..... 400/593
6,315,474 B1 * 11/2001 Giles et al. ..... 400/621

FOREIGN PATENT DOCUMENTS

JP 62-208891 9/1987
JP 10-34591 2/1998

* cited by examiner

*Primary Examiner*—Allan N. Shoap
*Assistant Examiner*—Ghassem Alie
(74) *Attorney, Agent, or Firm*—Rabin & Berdo, P.C.

(57) ABSTRACT

There is provided a recording material cutting device having a mechanism for cutting a recording material by the whole edge of a cutter blade so as to prolong the service life of the cutter blade, while allowing to simplify the structure of the device, to downsize the device, and to improve the straightness of the cut portion of the recording material.

Upon starting the cutting, the cutting-in depth of the cutter blade 130 is the deepest, and the recording material 113 is cut by the near-root portion of the cutter blade 130. As the whole of the cutter unit 112 moves in the direction C while the seizing member 123 abuts onto the cammed surface of the cammed portion 132, the cutter holder 122 is gradually lifted up so that the cutting-in depth of the cutter blade 130 into the recording material 113 is gradually shallowed. Upon reaching the raised center of the cammed portion 132, the height of the cutter holder 122 becomes the maximum while the cutting-in depth of the cutter blade 130 becomes the minimum, so that the cutter blade 130 cuts the recording material 113 at the near-tip portion of the cutter blade 130. As the cutter unit 112 further travels to the right, the cutting-in amount of the cutter blade 130 becomes gradually deep again.

5 Claims, 26 Drawing Sheets

RECORDING MATERIAL CUTTING DEVICE

TECHNICAL FIELD

The present invention relates to a recording material cutting device to be utilized in an image-forming apparatus such as a plotter, printer, facsimile and copying machine.

BACKGROUND ART

In many image-forming apparatus such as of an ink-jet type, there is intermittently transferred a recording material wound in a roll shape while drawing out the recording material from the roll, and there is formed an image of 1 band on the recording material at a time, by a recording head which reciprocates in a direction (widthwise direction of the recording material) substantially perpendicular to the recording material transferring direction. Many of such image-forming apparatus are provided with recording material cutting devices for cutting away those portions of the recording materials which have been formed with the pertinent images. Basically, recording material cutting devices include a cutter blade or holder means for holding such a cutter blade, and a driving portion for reciprocating it in the widthwise direction of the recording material. While the transferring operation of the recording material is stopped, the cutter blade is to move in a direction (i.e., widthwise direction of the recording material) substantially perpendicular to the recording material transferring direction similarly to the recording head, to thereby cut the recording material.

Although cutter edge surfaces have a certain extent of length, keeping on cutting recording materials at only one point of a cutter edge surface will result in a rapid abrasion at the one point to thereby shorten the service life of the cutter blade itself. Thus, as disclosed in JP-A-8-290387 (290387/1996) of the present applicant, it has been proposed that the cutter blade moving in the widthwise direction of the recording material in a recording material cutting device is to be also displaced in a direction vertical to the recording material (up-and-down direction) within a certain extent so as to cut the recording material by the whole of the cutter blade, to thereby prolong the service life of the cutter blade.

The recording material cutting device described in the JP-A-8-290387 is provided with a cutter rail. When a rotatable guiding roller is moved in the widthwise direction of the recording material along a cammed surface (tapered surface) provided at the lower side of the cutter rail, there is changed, relative to the recording material, the height of the cutter blade coupled to the guiding roller. This causes the substantially whole of the cutter blade to be used to cut the recording material so as to uniformalize the abrasion of the cutter blade, to thereby prolong the service life of the cutter blade.

Further, there has been known a recording material cutting device in which a cutter blade is laterally inclined to a recording material, i.e., the side of the cutter blade is inclined to the upstream or downstream side in the transferring direction relative to the surface of the recording material to a certain extent. FIGS. 35 and 36 show an example of such a recording material cutting device. FIG. 35 is a perspective view of the recording material cutting device viewed diagonally from the above, and FIG. 36 is a cross-sectional view of the cutter blade portion of the device of FIG. 35 taken along a cross section including a straight line parallel to the transferring direction (i.e., direction D) of the recording material.

The recording material cutting device shown in FIGS. 35 and 36 includes a rotatable guiding roller 64 which is moved up and down along a cammed surface at the lower side of a cutter rail 70 when a cutter base 61 is moved along a guiding rail 60 in a direction C. Such an upper and lower movement of the guiding roller 64 causes a cutter arm 65 to swing about a shaft 63, thereby causing a cutter holder 66 upwardly urged by a spring 67 to move upwardly and downwardly. The cutter holder 66 has a lower end provided with a cutter blade 30 so that the cutter blade 30 moves upwardly and downwardly together with the movement of the cutter holder 66. Acting as a recording material placing part is a platen 17 formed with a cutter-aimed groove 31, such that the cutter blade 30 is moved upwardly and downwardly within the cutter-aimed groove 31 to thereby change the cutting-in depth for a recording material 13. Such a mechanism allows to cut the recording material 13, by the whole of the cutter blade 30 mounted to the lower end of the cutter holder 66.

As seen from FIG. 36, the cutter blade 30 is inclinedly held at the lower end of the cutter holder 66. As a result, upon starting the cutting of the recording material 13, those portions of the recording material at the left and right of the cutter blade 30 in FIG. 36 tend to be cut up upwardly and downwardly, respectively, i.e., in the different directions. This reduces the resistance of the recording material 13 against the cutter blade 30, to thereby improve an entering ability of the cutter blade 30 into the recording material. As a result, it becomes possible to restrict the occurrence of such a phenomenon that the recording material is twisted or creased to thereby wave or ripple the cut portion of the recording material upon starting the cutting.

According to the conventional recording material cutting device as described above, it certainly becomes possible to realize such an effect to prolong the service life of the cutter blade, by upwardly and downwardly displacing the cutter holder holding the cutter blade in the inclined state, so as to cut the recording material by the whole of the cutter blade. However, merely upwardly and downwardly moving the cutter holder changes that position in the direction D (see FIG. 36) where the cutter blade cuts the recording material, thereby deviating the cut portion of the recording material from a straight line and causing the cut portion to become a curved line, so that the straightness of the cut portion is deteriorated. Such a deterioration of the straightness is considerably problematic, in items such as a business-use poster the dimensions of which are strictly defined.

Further, the conventional recording material cutting device requires the rail having the cammed surface as described above, so as to cause: the cutter blade moving in the widthwise direction of the recording material; to be displaced upwardly and downwardly during the movement of the cutter blade. Such a rail is to be installed over the full width of the recording material, to thereby complicate the structure of the device and cause a difficulty in downsizing the device.

In the aforementioned recording material cutting device, the cutter blade located above the recording material is lowered to thereby enter the recording material while forming an acute angle between the cutter edge surface and the recording material, such that the cutter blade travels in the direction (widthwise direction of the recording material) perpendicular to the recording material transferring direction to thereby cut the recording material. In this case, particularly to avoid a cut-jam where the recording material is buckled or creased upon starting the cutting, there exists such a recording material cutting device provided with, near the cutter blade, a seizing member for resiliently seizing the recording material downwardly.

Meantime, keeping on using a certain region of an edge surface of a cutter blade rapidly wears the certain region and rapidly deteriorates the cutting quality. When the recording material is made of paper, the thus deteriorated cutting quality causes such problems that: the cut portion of the recording material becomes linty or nappy; the recording material is buckled to be wavy; and/or the straightness of the sectioned surface of the recording material is deteriorated after cutting. When the recording material is a coated paper, the deteriorated cutting quality may cause particles of the coating agent.

The deteriorated cutting quality of a cutter blade requires replacement of: the whole cutter blade; or that region of the edge surface of the cutter blade which is used to cut a recording material. The latter situation requires a mechanism for stepwise changing over: the protruding amount of the edge of the cutter-blade; beyond the aforementioned seizing member, upon cutting. Those recording material cutting devices provided with such mechanisms are allowed to effectively use the whole edge surface of the cutter blade by the changeover, to thereby advantageously prolong the service life of the cutter blade and reduce the replacement frequency of the cutter blade. Typically, cutter blades are provided by integrating materials such as plastics with edges of metal held by the materials. This is to reduce the risk such as of injury of user's fingers upon replacement of the cutter blade, such that the whole of the edge and the plastics is replaced.

Meanwhile, even in a recording material cutting device capable of changing over the recording material cutting region of the cutter blade by changing or varying the protruding amount of the edge of the cutter blade, there will be caused the following problems in case of firstly using the near-root portion of the cutter blade rather than firstly using the near-tip portion of the cutter blade.

Using a cutter blade to cut a recording material may cause the recording material to be deformed by buckling and/or bending such as due to the wear of the edge surface and/or an unexpected accident, as mentioned above. Further, during the cutting by the near-root portion of the edge, those portions of the edge which are more extreme than the near-root portion are protruded beyond the aforementioned seizing member. Thus, when such a cutter blade is about to forcibly enter the bent and deformed recording material, the recording material may strike the unused tip portion of the cutter blade depending on the deformation of the recording material, and may break the tip portion. Even partly broken cutter blades in such a way should be wholly replaced, even if the remaining portions of the cutter blades are not broken.

Particularly, when those users unfamiliar with the usage of the recording material cutting device are to change the protruding amount of the edge of the cutter blade, such users are unaware of the appropriate degree of usage of the cutter blade for changing the protruding amount of the edge. This may cause such a situation where a certain portion of the edge is kept used for an excessively long time to thereby break the edge, so that the cutter blade should be replaced at a period rather shorter than the inherent service life of the cutter blade. Further, merely enabling to stepwise change the protruding amount of the edge of the cutter blade has caused such an inconvenience to find an appropriate region of the edge by completely checking the cutting qualities of the respective regions when the previously used region is forgotten.

DISCLOSURE OF THE INVENTION

The present invention has been carried out in view of the technical circumstances as described above, and it is therefore an object of the present invention to provide a recording material cutting device for allowing to simplify the structure of the device and to downsize the device while having a mechanism for cutting a recording material by the whole edge of a cutter blade so as to prolong the service life of the cutter blade.

It is another object of the present invention to provide a recording material cutting device capable of improving the straightness of the cut portion of the recording material.

It is a further object of the present invention to provide a recording material cutting device: which allows to simplify the structure of the device and to downsize the device while having a mechanism for cutting a recording material by the whole edge of a cutter blade so as to prolong the service life of the cutter blade; and which is capable of the straightness of the cut portion of the recording material.

It is yet another object of the present invention to provide a recording material cutting device capable of changing the cutting position of the cutter blade in a predetermined sequence, thereby assuredly avoiding a situation where the unused region of the edge surface of the cutter blade is broken, and thereby effectively using the edge surface of the cutter blade.

To achieve the above object, the first invention resides in a recording material cutting device including a cutter blade for cutting a recording material by traveling the cutter blade in the direction substantially perpendicular to the recording material transferring direction, the recording material being placed and transferred on a recording material placing part of an image-forming apparatus, the recording material cutting device comprising: cutter blade fixing means fixedly mounted with the cutter blade; urging means for resiliently urging the cutter blade fixing means in the direction toward the recording material placing part; cutter blade traveling means for traveling, upon the cutting motion, the cutter blade fixing means together with the urging means in the direction substantially perpendicular to the recording material transferring direction and parallelly to the recording material placing part; a cammed surface having up-and-downness at its upper surface and being formed at that portion of the recording material placing part, which is along the traveling path of the cutter blade; and recording material seizing means provided integrally with the cutter blade fixing means, so as to resiliently receive the urging force of the urging means in a state of clamping the recording material between the recording material seizing means and the cammed surface upon the cutting motion, to thereby seize the recording material.

The second invention is subordinated to the first invention, wherein the cutter blade is fixed such that the side surface of the cutter blade is inclined from the direction in which the cutter blade fixing means is urged, and wherein the urging means urges the cutter blade fixing means in the direction perpendicular to the recording material placing part.

The third invention is subordinated to the first invention, wherein the cutter blade is fixed such that the side surface of the cutter blade is parallel to the direction in which the cutter blade fixing means is urged, and wherein the urging means urges the cutter blade fixing means in the direction inclined from the direction perpendicular to the recording material placing part.

The fourth invention resides in a recording material cutting device including a cutter blade for cutting a recording material by traveling the cutter blade in the direction substantially perpendicular to the recording material transferring direction, the recording material being placed and transferred on a recording material placing part of an image-forming apparatus, the recording material cutting device comprising: cutter blade fixing means fixedly mounted with the cutter blade; cutter blade supporting means rotatably mounted with the cutter blade fixing means; urging means for resiliently urging the cutter blade supporting means in the direction toward the recording material placing part; turn-urging means for resiliently turn-urging the cutter blade fixing means in the direction for shallowing the cutting-in depth of the cutter blade into the recording material; cutter blade traveling means for traveling, upon the cutting motion, the cutter blade supporting means together with the cutter blade fixing means, the turn-urging means and the urging means, in the direction substantially perpendicular to the recording material transferring direction and parallelly to the recording material placing part; a cammed surface having up-and-downness at its upper surface and being formed at that portion of the recording material placing part, which is along the traveling path of the cutter blade; and recording material seizing means provided integrally with the cutter blade fixing means, so as to resiliently receive the urging force of the urging means in a state of clamping the recording material between the recording material seizing means and the cammed surface upon the cutting motion, to thereby seize the recording material; the recording material seizing means being adapted to turn, correspondingly to the shape of the cammed surface, the cutter blade fixing means against the turn urging force of the turn-urging means, in the direction for deepening the cutting-in depth of the cutter blade into the recording material.

The fifth invention is subordinated to the fourth invention, wherein the cutter blade is fixed such that the side surface of the cutter blade is inclined from the turning-aimed plane for the cutter blade fixing means; and wherein the cutter blade fixing means is mounted to the cutter blade supporting means such that the turning-aimed plane for the cutter blade fixing means becomes perpendicular to the recording material placing part.

The sixth invention is subordinated to the fourth invention, wherein the cutter blade is fixed such that the side surface of the cutter blade is parallel to the turning-aimed plane for the cutter blade fixing means; and wherein the cutter blade fixing means is mounted to the cutter blade supporting means such that the turning-aimed plane for the cutter blade fixing means is inclined from a plane perpendicular to the recording material placing part.

The seventh invention resides in a recording material cutting device including a cutter blade for cutting a recording material by traveling the cutter blade in the direction substantially perpendicular to the recording material transferring direction, the recording material being placed and transferred on a recording material placing part of an image-forming apparatus, the recording material cutting device comprising: cutter blade fixing means fixedly mounted with the cutter blade; cutter blade supporting means translatably mounted with the cutter blade fixing means; urging means for resiliently urging the cutter blade supporting means in the direction toward the recording material placing part; cutter blade translating means coupled to the cutter blade fixing means and rotatably mounted to the cutter blade supporting means, so as to translate the cutter blade fixing means coupled to the cutter blade translating means by the rotating motion of the cutter blade translating means into a direction for deepening or shallowing the cutting-in depth of the cutter blade into the recording material; turn-urging means for resiliently turn-urging the cutter blade translating means in the direction for shallowing the cutting-in depth of the cutter blade into the recording material; cutter blade traveling means for traveling, upon the cutting motion, the cutter blade supporting means together with the cutter blade fixing means, the cutter blade translating means, the urging means, and the turn-urging means, in the direction substantially perpendicular to the recording material transferring direction and parallelly to the recording material placing part; a cammed surface having up-and-downness at its upper surface and being formed at that portion of the recording material placing part, which is along the traveling path of the cutter blade; and recording material seizing means provided integrally with the cutter blade translating means, so as to resiliently receive the urging force of the urging means in a state of clamping the recording material between the recording material seizing means and the cammed surface upon the cutting motion, to thereby seize the recording material; the recording material seizing means being adapted to turn, correspondingly to the shape of the cammed surface, the cutter blade translating means against the turn urging force of the turn-urging means, in the direction for deepening the cutting-in depth of the cutter blade into the recording material.

The eighth invention is subordinated to the seventh invention, wherein the cutter blade is fixed to the cutter blade fixing means such that the side surface of the cutter blade is inclined from the translating direction; and wherein the cutter blade fixing means is mounted to the cutter blade supporting means such that the translating direction of the cutter blade fixing means becomes perpendicular to the recording material placing part.

The ninth invention is subordinated to the seventh invention, wherein the cutter blade is fixed to the cutter blade fixing means such that the side surface of the cutter blade is parallel to the translating direction; and wherein the cutter blade fixing means is mounted to the cutter blade supporting means such that the translating direction of the cutter blade fixing means is inclined from a direction perpendicular to the recording material placing part.

The tenth invention resides in a recording material cutting device including a cutter blade for cutting a recording material by traveling the cutter blade in the direction substantially perpendicular to the recording material transferring direction, the recording material being placed and transferred on a recording material placing part of an image-forming apparatus, the recording material cutting device comprising: rail means installed in the widthwise direction of the recording material and parallelly to the recording material, the rail means being formed with a cammed surface at that side opposing to the recording surface of the recording material; cutter blade traveling means for traveling along the rail means; cutter blade fixing means fixed with the cutter blade at that side of the cutter blade fixing means which opposes to the recording material, the cutter blade fixing means being held by the cutter blade traveling means such that the cutter blade fixing means is allowed to translate in the direction for shallowing or deepening the cutting-in depth of the cutter blade into the recording material; swinging means mounted to the cutter blade traveling means in a manner to be swingable within a plane perpendicular to the recording material, the swinging means being provided with a guiding member for abutting onto the cammed surface of the rail means and with an abutting member for abutting onto a part of the cutter blade fixing means; and urging means mounted to the cutter blade traveling means, so as to push the guiding member against the cammed surface of the rail means, to thereby urge the cutter supporting means in a direction for shallowing the cutting-in depth of the cutter blade into the recording material.

The eleventh invention is subordinated to the tenth invention, wherein the translating direction of the cutter blade fixing means is inclined from a direction perpendicular to the recording material; and wherein the cutter blade is fixed such that the side surface of the cutter blade becomes parallel to the translating direction of the cutter blade fixing means.

The twelfth invention resides in a recording material cutting device including a cutter blade for cutting a recording material by traveling the cutter blade in the direction substantially perpendicular to the recording material transferring direction, the recording material being placed and transferred on a recording material placing part of an image-forming apparatus, the recording material cutting device comprising: an independent cutter blade or a cutter blade held by holding means; accommodating means provided separately from the cutter blade or holding means, so as to accommodate the cutter blade or holding means in a manner moveable in the direction toward the recording material placing part; urging means for resiliently urging the cutter blade or holding means and the accommodating means in the direction toward the recording material placing part; seizing means provided at the accommodating means, so as to resiliently receive the urging force of the urging means in a state of clamping the recording material between the seizing means and the recording material placing part upon the cutting motion, to thereby seize the recording material; protruding amount varying means for varying the amount (protruding amount) of the cutter blade protruding beyond the accommodating means in the direction toward the recording material placing part; and traveling means for traveling, upon the cutting motion, the accommodating means together with the urging means and the protruding amount varying means, in a direction which is parallel to the recording material placing part and substantially perpendicular to the recording material transferring direction.

The thirteenth invention resides in a recording material cutting device including a cutter blade for cutting a recording material by traveling the cutter blade in the direction substantially perpendicular to the recording material transferring direction, the recording material being placed and transferred on a recording material placing part of an image-forming apparatus, the recording material cutting device comprising: an independent cutter blade or a cutter blade held by holding means; accommodating means provided separately from the cutter blade or holding means, so as to accommodate the cutter blade or holding means in a manner moveable in the direction toward the recording material placing part; urging means for resiliently urging the cutter blade or holding means and the accommodating means in the direction toward the recording material placing part; a cammed surface having up-and-downness at its upper surface and being formed at that portion of the recording material placing part, which is along the traveling direction of the cutter blade; seizing means provided at the accommodating means, so as to resiliently receive the urging force of the urging means in a state of clamping the recording material between the seizing means and the cammed surface upon the cutting motion, to thereby seize the recording material; protruding amount varying means for varying the amount (protruding amount) of the cutter blade protruding beyond the accommodating means in the direction toward the recording material placing part; and traveling means for traveling, upon the cutting motion, the accommodating means together with the urging means and the protruding amount varying means, in a direction which is parallel to the recording material placing part and substantially perpendicular to the recording material transferring direction.

The fourteenth invention is subordinated to the thirteenth invention, wherein the cammed surface is formed such that the cutter blade is caused to most deeply cut into the recording material upon breaking into the recording material, within a region through which the cutter blade passes during the period from the breaking into the recording material up to the completion of cutting.

The fifteenth invention is subordinated to any one of the twelfth, thirteenth and fourteenth inventions, wherein the protruding amount varying means includes: a protruding amount varying direction restricted to a direction for increasing the protruding amount; and indicating means for indicating the current protruding amount.

The sixteenth invention is subordinated to any one of the twelfth, thirteenth, fourteenth and fifteenth inventions, wherein the protruding amount varying means comprises: second urging means for urging the cutter blade or holding means in a direction opposite to a direction toward the recording material placing part, with respect to the accommodating means; and changeover means located between the cutter blade or holding means and the accommodating means, so as to receive the urging force of the second urging means, and so as to stepwise change over the relative positions between the cutter blade or holding means and the accommodating means in the direction toward the recording material placing part.

The seventeenth invention is subordinated to the sixteenth invention, wherein the height difference of the cammed surface is equal to or smaller than one step of the relative positions between the cutter blade or holding means and the accommodating means to be changed over by the changeover means.

The eighteenth invention is subordinated to either of the sixteenth and seventeenth inventions, wherein the changeover means comprises a disc-like member, which disc-like member has a circumference inscribed with numbers each corresponding to the protruding amount, and which disc-like member has a rotating direction restricted to either of clockwise or counterclockwise correspondingly to the increasing direction of the protruding amount.

According to the first through third inventions, the recording material placing part is provided with the cammed surface, so that the cutting-in depth of the cutter blade into the recording material is varied as the cutter blade travels, thereby resultingly allowing to cut the recording material by using the whole of the cutter blade, to thereby prolong the service life of the cutter blade and to eliminate the necessity of a cutter rail having been required in the conventional device so as to vary the cutting-in depth of the cutter blade into a recording material. This allows to readily simplify the structure of the device and to downsize the device.

According to the third invention, the side surface of the cutter blade is fixed in a state parallel to the urging direction of the cutter blade fixing means, and the cutter blade fixing means is urged in a direction inclined from the direction perpendicular to the recording material placing part, thereby allowing to improve the straightness of the cut portion of the recording material.

According to the fourth through sixth inventions, there are provided the turn-urging means in addition to the urging means, and the recording material seizing means formed integrally with the rotatably mounted cutter blade fixing means. Thus, in addition to the effects according to the first through third inventions, it becomes possible to reduce the up-and-downness of the recording material placing part required to change the cutting-in depth of the cutter blade as compared with the first through third inventions, and the straightness of the cut portion of the recording material can be improved to that extent.

According to the sixth invention, the side surface of the cutter blade is fixed in a state parallel to the turning-aimed plane of the cutter blade fixing means and the cutter blade fixing means is mounted to be inclined from a direction perpendicular to the recording material placing part, to thereby further improve the straightness of the cut portion of the recording material.

According to the seventh through ninth inventions, the cutting-in depth of the cutter blade into the recording material is varied by the translation of the cutter blade relative to the recording material upon the cutting motion. Thus, in addition to the effects of the first through sixth inventions, the angle between the edge surface of the cutter blade and the recording material is kept substantially constant throughout the cutting motion from the starting to the ending, to thereby stabilize the cutting motion.

According to the ninth invention, the side surface of the cutter blade is mounted parallelly to the cutter blade fixing means and the cutter blade fixing means translates in a state inclined from the direction perpendicular to the recording material placing part, thereby allowing to improve the straightness of the cut portion of the recording material.

According to the tenth and eleventh inventions, the cutting-in depth of the cutter blade into the recording material is changed by the cammed surface of the rail means when the cutter blade travels, thereby resultingly allow to cut the recording material by the whole of the cutter blade. This enables to prolong the service life of the cutter blade similarly to the conventional. Further, the cutting-in depth of the cutter blade into the recording material is varied by the translation of the cutter blade relative to the recording material upon the cutting motion. Thus, the angle between the edge surface of the cutter blade and the recording material is kept substantially constant throughout the cutting motion from the starting to the ending, to thereby stabilize the cutting motion.

According to the eleventh invention, the side surface of the cutter blade is fixed parallelly to the translating direction of the cutter blade fixing means, and the cutter blade fixing means is translated in the direction inclined from the direction perpendicular to the recording material placing part, to thereby allow to improve the straightness of the cut portion of the recording material.

According to the twelfth through eighteenth inventions, there is provided the protruding amount varying means for changing over the region of the cutter blade for cutting the recording material. Thus, the substantially whole of the edge surface of the cutter blade can be effectively used, to thereby prolong the service life of the cutter blade, as compared with the situation for using only a part of the edge surface of the cutter blade. Further, the direction of the protruding amount varying means for changing over the cutting region of the cutter blade is restricted to the direction from the tip end portion toward the root of the cutter blade. Thus, even when the recording material is deformed somehow and the cutter blade has entered the deformed portion, the recording material never strikes the unused portion of the cutter blade, thereby allowing to keep on using the cutter blade until the inherent service life of the cutter blade is fulfilled.

According to the thirteenth invention, there is further formed the cammed surface at that portion of the recording material placing part which is along the traveling direction of the cutter blade, to thereby allow to cut the recording material by using a certain width of each of the switchable regions of the cutter blade. Thus, it becomes possible to prolong the period of time where each of the switchable regions of the cutter blade is worn, as compared with a situation where the recording material is cut only by a single point of each cutting region. As a result, the service life of the whole of the cutter blade can be effectively prolonged.

According to the fifteenth invention, there is provided the indicating means for indicating the current protruding amount of the cutter blade. Thus, even when those users unfamiliar with the usage of the recording material cutting device are to conduct the switching operation of the cutter blade, the users are allowed to assuredly change over to the region to be used next. This assuredly avoids such mistakes that the cutter blade is replaced while leaving the unused portions, and/or that the already used and worn portion of the cutter blade is used again to thereby bend and/or buckle the recording material.

BEST MODE FOR CARRYING OUT THE INVENTION

Figure 1:
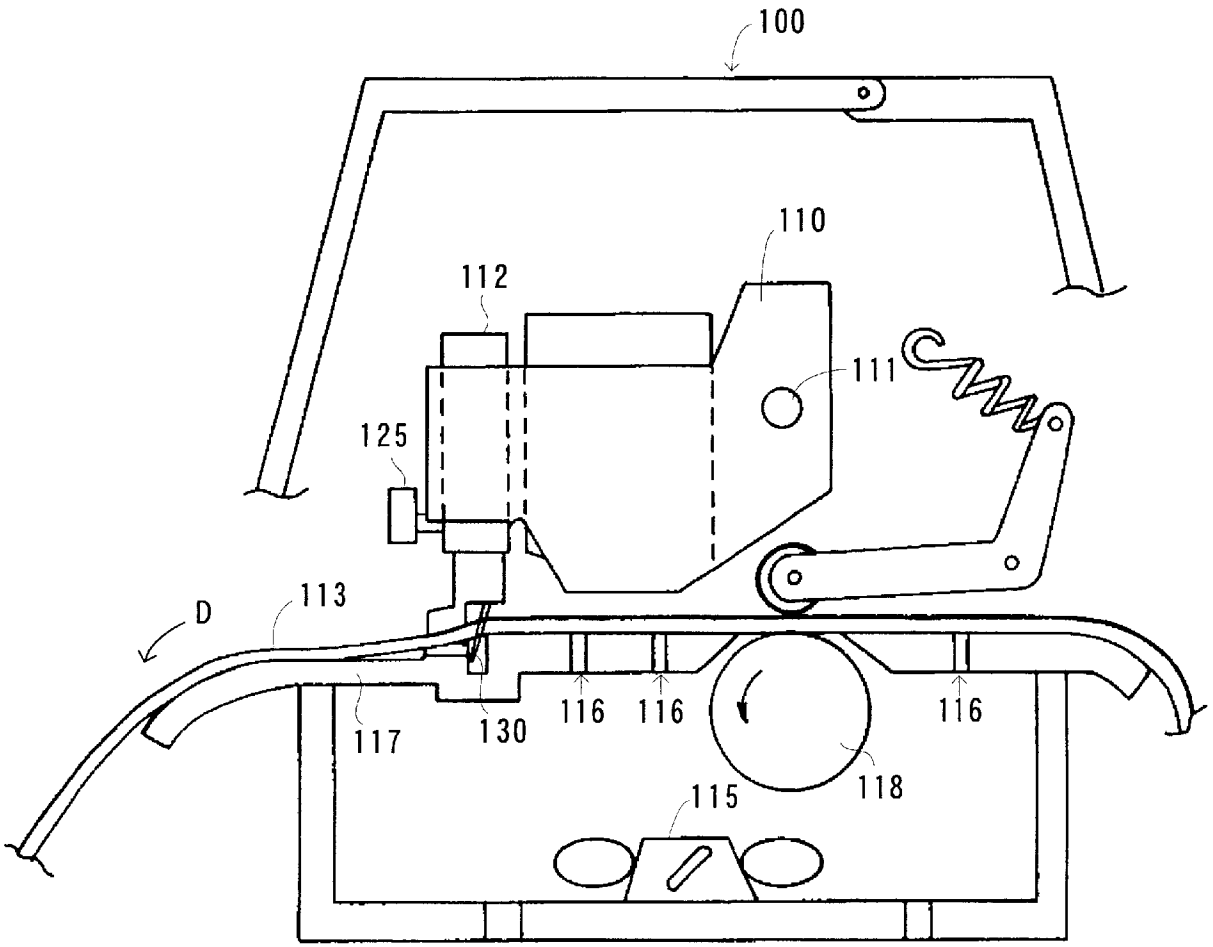
FIG. 1 is a schematic cross-sectional view of an ink-jet recording device taken along a plane perpendicular to a traveling direction of a carriage (i.e., plane including a straight line parallel to the recording material transferring direction)

There will be described hereinafter an "embodiment 1" through an "embodiment 7" which are the best modes for practicing the present invention, with reference to the accompanying drawings. It is assumed that the recording material cutting devices according to the "embodiment 1" through "embodiment 6" are utilized for an ink-jet recording device as an exemplary image recording device, and the recording material cutting device according to the "embodiment 7" is utilized for a color plotter.

Note, in each of FIG. 1 through FIG. 15 to be referred to in the description of the "embodiment 1" through "embodiment 6", reference numerals having the same lower 2-digits represent those mutually identical or corresponding elements, among those reference numerals designating respective portions of the device and the like. Further, in each of FIG. 1 through FIG. 15, the arrow C (widthwise direction of the recording material), arrow D (recording material transferring direction) and arrow H (up-and-down direction) consistently designate their attributed directions, respectively.

Embodiment 1

Figure 2:
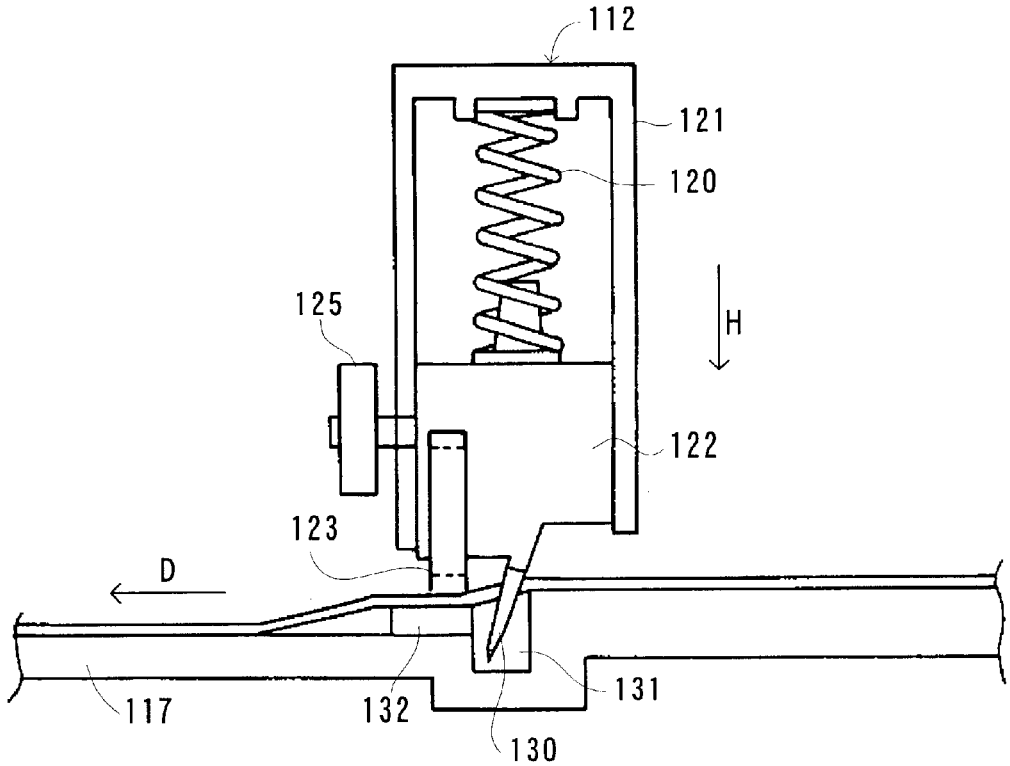
FIG. 2 is an enlarged cross-sectional view of a cutter unit 112 of FIG. 1.

FIG. 1 through FIG. 4 show a recording material cutting device of an embodiment 1. Among them, FIG. 1 is a schematic cross-sectional view of an ink-jet recording device 100 taken along a plane perpendicular to a traveling direction of a carriage (i.e., plane including a straight line parallel to the recording material transferring direction), and FIG. 2 is an enlarged cross-sectional view of a cutter unit 112 of FIG. 1.

As shown in FIG. 1, the ink-jet recording device 100 is installed with a carriage 110 which reciprocally travels along a guiding rail 111 in a direction perpendicular to the drawing plane of FIG. 1. The carriage 110 is mounted with a cutter unit 112 so that the cutter unit 112 travels together with the carriage 110. During a printing motion, there is intermittently transferred a recording material (typically, paper) 113 by a transferring roller 118 in the right-to-left direction (designated by an arrow D) in FIG. 1 by a predetermined feeding amount.

There is provided a fan 115 below the recording material 113, so as to suck the recording material 113. When this fan 115 is rotated in a direction for sucking air via vent holes 116 provided at a platen 117 acting as a recording material placing part, the recording material 113 is sucked on the platen 117 thereunder by an appropriate sucking force.

At the surface for placing the recording material 113, the platen 117 is formed with a cutter-aimed groove 131 along a direction which the cutter unit 112 travels in. Upon cutting the recording material 113, there is moved a cutter holder 122 (corresponding to the "cutter blade fixing means" recited in the pertinent claims) in the reverse-to-obverse direction of the drawing plane of FIG. 2 under a condition that the cutter blade 130 is brought into the cutter-aimed groove 131, and upon reaching the end portion of the cutter-aimed groove 131, the cutter blade is drawn out of the cutter-aimed groove 131 (i.e., lifted upwardly) and the cutter holder 122 is moved in the obverse-to-reverse direction.

As shown in FIG. 2, the cutter holder 122 made of plastics has a lower end portion for fixedly holding a cutter blade 130 made of metal in a manner that the side surface of the edge is slightly inclined from a vertical plane. Further, as shown in FIG. 2, there is provided a cammed portion 132 integrated with the platen 117 or formed as the platen 117 itself, at the upper portion of that wall at the downstream side in the recording material transferring direction (direction D), of the walls interposing the cutter-aimed groove 131 therebetween. The wall at the upstream side of the transferring direction (direction D) is formed to be higher than the upper surface (cammed surface) of the cammed portion 132. Such an inclination of the side surface of the edge relative to the vertical plane and the height difference between the walls at both sides of the cutter-aimed groove 131 are designed such that the angle formed between the side surface of the cutter blade 130 and the recording material 113 becomes an appropriate value inclined from a right angle.

Setting the angle formed between the side surface of the cutter blade 130 and the recording material 113 at such a value causes those portions of the recording material 113 at the right and left of the cutter blade 130 in FIG. 2 to tend to be cut up downwardly and upwardly, respectively, i.e., in the mutually different directions. This reduces the resistance of the recording material 113 relative to the cutter blade 130, to thereby improve an entering ability of the cutter blade 130 into the recording material 113, thereby resultingly allowing to restrict the occurrence of such a phenomenon that the recording material is twisted or creased. Such a technique to improve the entering ability of the cutter blade upon starting the cutting by inclining the side surface of the cutter blade relative to the recording material is shown in Japanese Patent Application No. HEI-9-266184 (266184/1997) filed by the present applicant.

Figure 3:
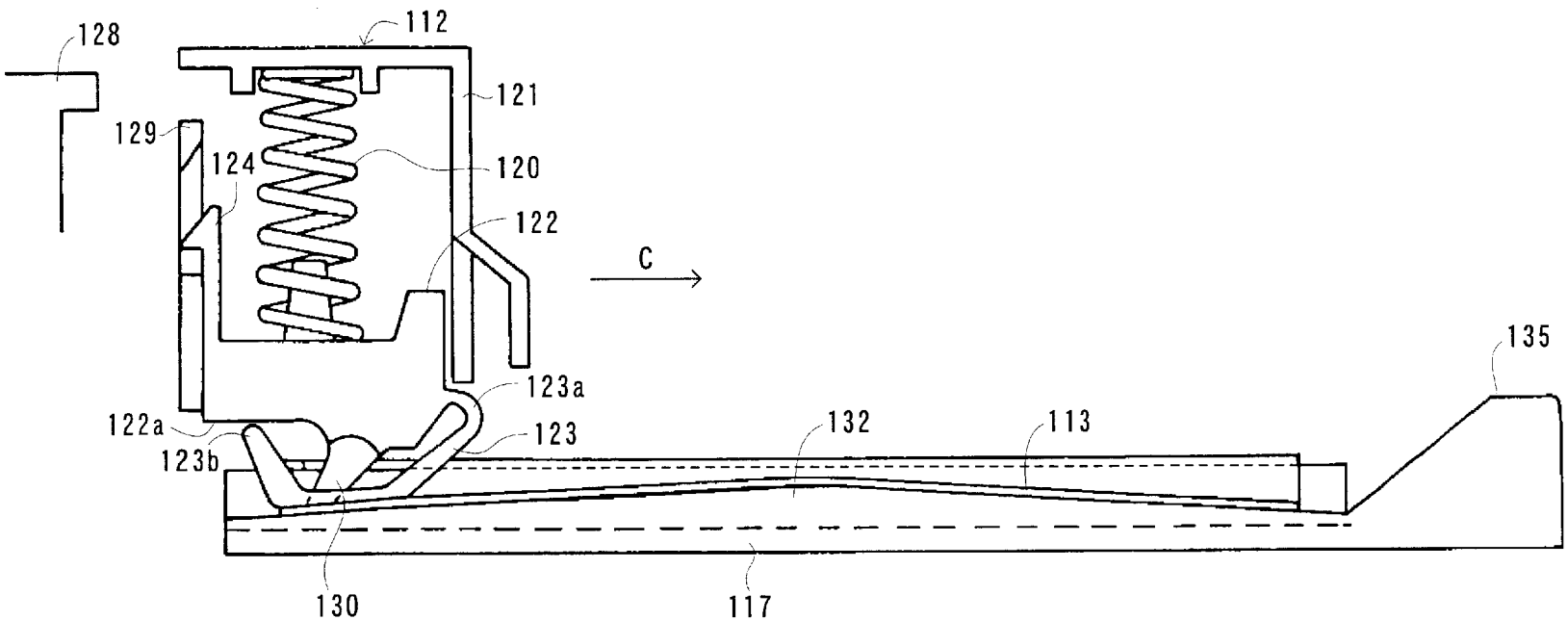
FIG. 3 is a front view of the cutter unit 112 in a taken-out state.
Figure 4:
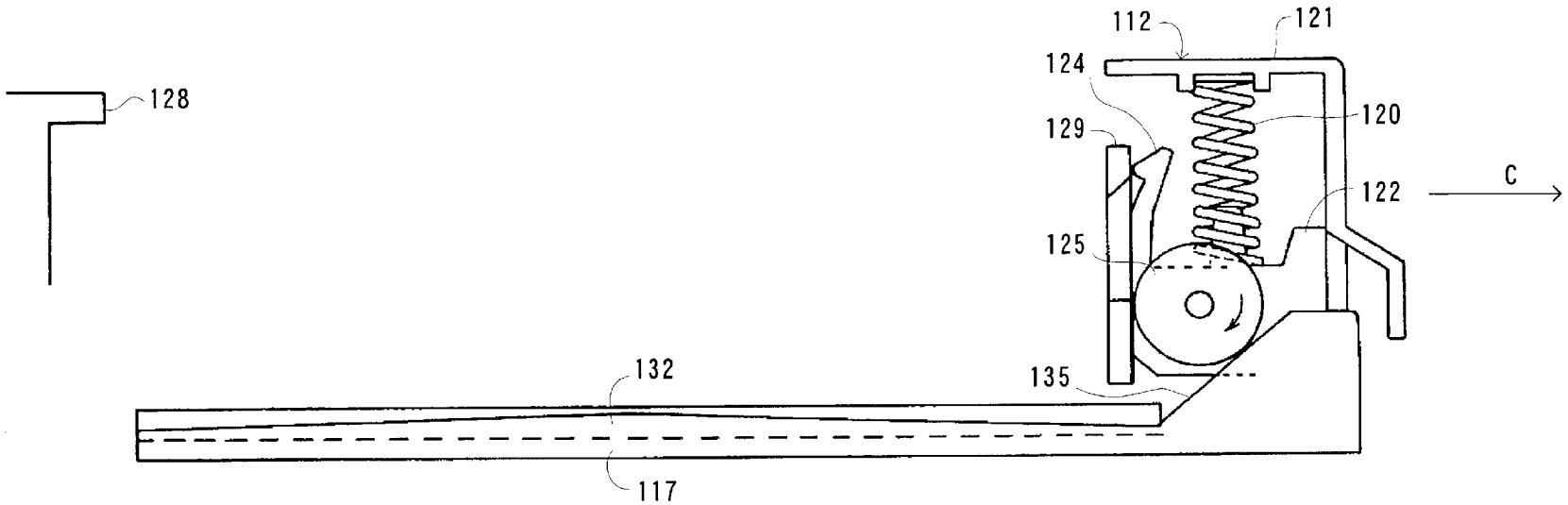
FIG. 4 is a front view of the cutter unit 112 in a taken-out state.

FIG. 3 and FIG. 4 are front views of the cutter unit 112 in a taken-out state (viewed from a direction opposite to the arrow D in FIG. 1). Note, although the actual dimension of the ink-jet recording device 100 is laterally wider than what are shown in FIG. 3 and FIG. 4, such a dimension is shown in a shortened manner than the actual lateral length so as to clarify the features of the ink-jet recording device 100.

The cutter unit 112 is constituted to include: a cutter pressurizing spring 120 (corresponding to "urging means" recited in pertinent claims); a cutter case 121; a cutter holder 122; a seizing member 123; and a rotatably provided cutter roller 125 (omitted in FIG. 3). The seizing member 123 is formed integrally with the cutter holder 122 out of the same material as the cutter holder 122, via coupling portion 123a, so as to have an appropriate resiliency. As described above, the cutter blade 130 made of metal is fixedly held at the lower end portion of the cutter holder 122, such that the side surface of the edge is slightly inclined from the vertical direction. The cutter holder 122 is accommodated in the cutter case 121 in an upwardly and downwardly moveable manner, and the cutter holder 122 is normally urged downwardly by the cutter pressurizing spring 120.

The cutter holder 122 is integrally formed with a hook pawl 124 for engaging with a recessed portion 129 provided at the upper portion of the cutter case 121 during the stand-by period of the cutter unit 112 such as the period of time for the printing motion where no cutting motion for the recording material is conducted. This causes the cutter holder 122 to be held at the upper position within the cutter case 121, against the downward urging force from the cutter pressurizing spring 120.

Upon the cutting motion for the recording material 113, the cutter unit 112 firstly moves leftwardly together with the carriage 110 in FIG. 3. There is provided a hook pawl releasing plate 128 at the leftmost end of the traveling region of the cutter unit 112, so that the hook pawl 124 is disengaged from the recessed portion 129 when the hook pawl 124 is struck by the hook pawl releasing plate 128 by the movement of the cutter unit 112. Disengaging the hook pawl 124 from the recessed portion 129 causes: the cutter holder 122 downwardly urged by the cutter pressurizing spring 120; to be instantaneously lowered. This downward urging force of the cutter holder 122 is received or stopped by such an action that the seizing member 123 abuts onto the cammed surface at the upper side of the cammed portion 132 so that the seizing member 123 yields in the clockwise direction in a state that the recording material 113 is clamped between the seizing member 123 and the cammed surface, to thereby cause a tip end portion 123*b* of the seizing member 123 to bump against a bump portion 122*a* at the bottom of the cutter holder 122 as shown in FIG. 3.

The urging force of the cutter pressurizing spring 120, the resilient force of the seizing member 123, and the length of the tip end portion 123*b* of the seizing member 123 are designed such that the cutter blade 130 is brought into the cutter-aimed groove 131 by an amount suitable for cutting the recording material 113 when the seizing member 123 has abutted against the cammed surface of the cammed portion 132. The seizing member 123 is downwardly pressurized by the cutter pressurizing spring 120 in this way, thereby firmly seizing the recording material 113. This allows to prevent the recording material 113 from being twisted, creased or bent, particularly upon starting the cutting motion.

During the cutting motion of the recording material 113, the seizing member 123 abuts onto the upper surface of the cammed portion 132 in a state clamping the recording material 113 therebetween, and the whole of the cutter unit 112 moves in the left-to-right direction (i.e., the direction designated by the arrow C) in FIG. 3. As shown in FIG. 3, the upper surface of the cammed portion 132 is formed with the cammed surface which is high at the central portion and low at the starting point side and the ending point side. Note, although the actual height difference of the up-and-downness is on the order of a few millimeters correspondingly to the height difference between the tip end and the root of the edge surface of the cutter blade 130, such a height difference is slightly exaggerated for better understanding in FIG. 3.

The height of the cammed portion 132 is low, at the left side in FIG. 3 where the cutter unit 112 is positioned upon starting the cutting motion. Thus, when the seizing member 123 abuts onto this portion of the cammed portion 132, the cutter blade 130 is deeply brought into the cutter-aimed groove 131. Since the cutter blade 130 is positioned near the upstream side wall within the cutter-aimed groove 131 in the transferring direction (direction D) as shown in FIG. 2, the recording material 113 is cut by the near-root portion of the edge surface of the cutter blade 130 when the cutter blade 130 is deeply brought into the cutter-aimed groove 131.

As the whole of the cutter unit 112 horizontally moves from the left toward the right in FIG. 3 during the cutting motion, the seizing member 123 gradually moves upwardly along the cammed surface of the cammed portion 132, to thereby lift up the cutter holder 122 and the cutter blade 130 held at the tip end of the cutter holder 122. Simultaneously with the above, the depth of the cutter blade 130 brought into the cutter-aimed groove 131 is gradually shallowed, so that the cutter blade 130 is caused to cut the recording material 113 at the more distal portion of the edge surface.

When the cutter unit 112 has come to the central portion of the cammed portion 132, the seizing member 123 reaches the highest position, and the cutting-in depth of the cutter blade 130 is shallowed to the minimum, so that the cutter blade 130 cuts the recording material 113 at the near-tip portion of the cutter blade 130. As the cutter unit 112 has passed the central portion of the cammed portion 132 and further moves rightwardly, the position of the seizing member 123 is gradually lowered and simultaneously therewith the cutting-in amount of the cutter blade 130 is also deepened, such that the cutter blade 130 cuts the recording material 113 again at the near-root portion of the cutter blade 130 upon reaching the rightmost portion in FIG. 3. Thus, the cutter blade 130 cuts the recording material 113 by using the substantially whole of the edge surface, while the cutter unit 112 makes a movement from the left end to the right end of its stroke.

In this way, cutting the recording material 113 by the whole of the edge of the cutter blade 130 drastically prolongs the service life of the cutter blade, as compared with the cutting situation only by a part of an edge of a cutter blade. This way to use the whole of the edge is disclosed in the aforementioned JP-A-8-290387.

However, the recording material cutting device disclosed in the JP-A-8-290387 is provided with a rail for moving a cutter blade upwardly and downwardly, such that this rail is provided with a cammed portion (tapered portion) having a varying height to thereby upwardly and downwardly move the cutter blade traveling in the widthwise direction of the recording material along the rail.

Contrary, the recording material cutting device of this embodiment is provided with the cammed portion 132 having its upper side cammed surface, on the downstream one of those walls interposing therebetween the cutter-aimed groove 131 in the transferring direction, such that the cutter unit 112 is traveled while bringing the seizing member 123 formed integrally with the cutter holder 122 to abut onto such a cammed surface. This allows to obtain the same effect as the conventional recording material cutting device, from the viewpoint to prolong the service life of a cutter blade.

The recording material cutting device of this embodiment further eliminates: the necessity of the aforementioned cutter rail to thereby simplify the structure of the device; and the necessity of the space for installing such a cutter rail thereby allowing to downsize the whole of the recording material cutting device. This aspect is a remarkable merit, as compared with the conventional recording material cutting device.

As shown in FIG. 2, the cutter roller 125 provided at the downstream side position in the transferring direction (direction D) of the cutter unit 112 has a rotary shaft fixed to the cutter holder 122. The cutter roller 125 is in a state separated from other members, such as during the stand-by period of the cutter unit 112 and during the cutting of the recording material.

However, when the cutter unit 112 has reached the vicinity of the rightmost portion in the traveling region thereof shown in FIG. 3 or FIG. 4, the cutter roller 125 abuts onto a roller guide 135 provided at the rightmost portion in FIG. 3. Since the roller guide 135 has a predetermined inclining angle, the cutter roller 125 is rotated and upwardly moved to thereby lift the whole of the cutter holder 122 when the cutter roller 125 further travels rightwardly after contacting with the roller guide 135. When the cutter holder 122 has been lifted up to a certain height, the hook pawl 124 formed integrally with the cutter holder 122 engages with the recessed portion 129 provided at the upper portion of the cutter case 121, so that the cutter holder 122 is again held at an upper position within the cutter case 121 against the downward urging force by the cutter pressurizing spring 120. Thereafter, while the cutter unit 112 travels leftwardly in FIG. 3 to thereby revert to such a stand-by position which is a situation just before the hook pawl 124 is struck by the hook pawl releasing plate 128, there is maintained the state where the cutter holder 122 is kept at the upper position within the cutter case 121.

In this embodiment, the upper cammed surface of the cammed portion 132 is formed such that the central portion is high and the starting point side and ending point side are low as shown in FIG. 3. However, it is possible to form the cammed surface such that one and the other of the starting point and ending point are high and low, respectively, to thereby form a simply tapered shape, or such that the high and low portions are repeated several times along the traveling path of the cutter unit. Further, the cammed portion 132 has been integrated with the platen 117 or has been formed as the platen 117 itself. However, the cammed portion and the platen may be separately formed.

Embodiment 2

Figure 5:
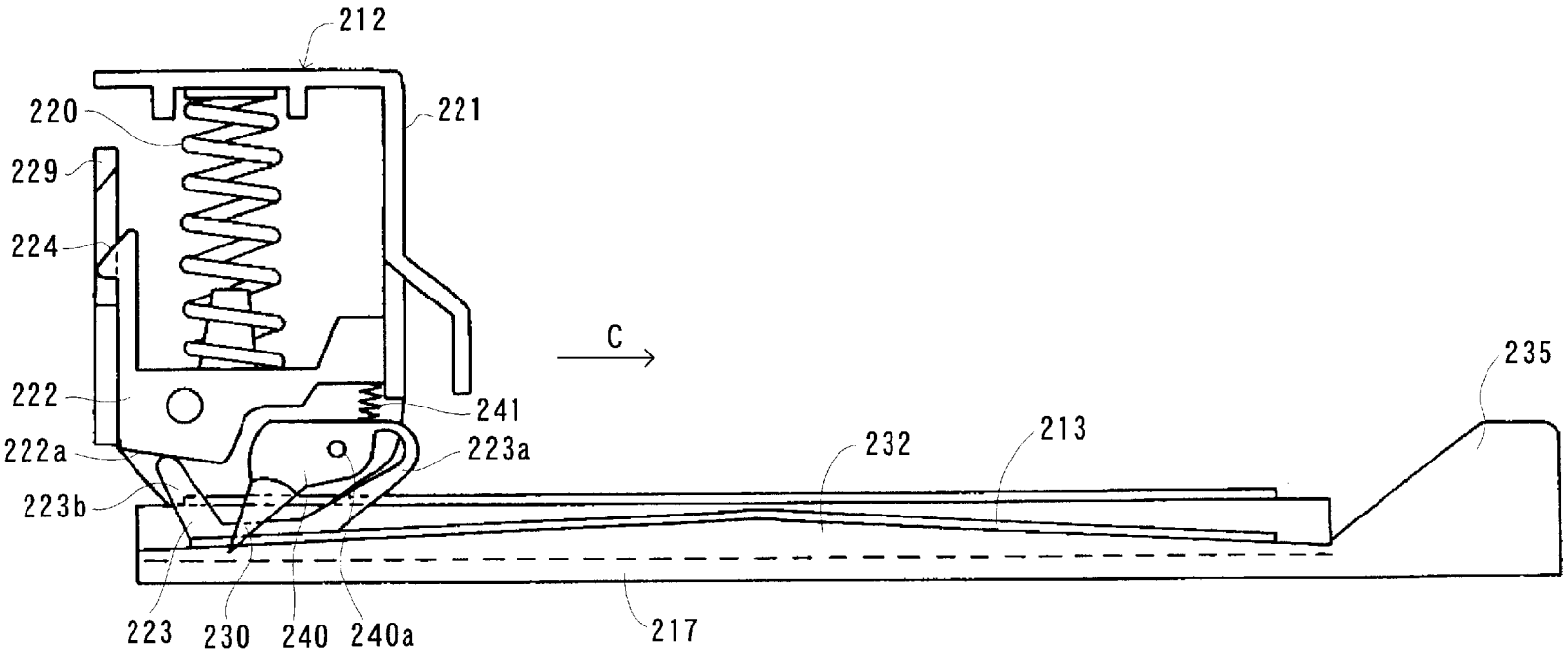
FIG. 5 is a front view corresponding to FIG. 3.
Figure 6:
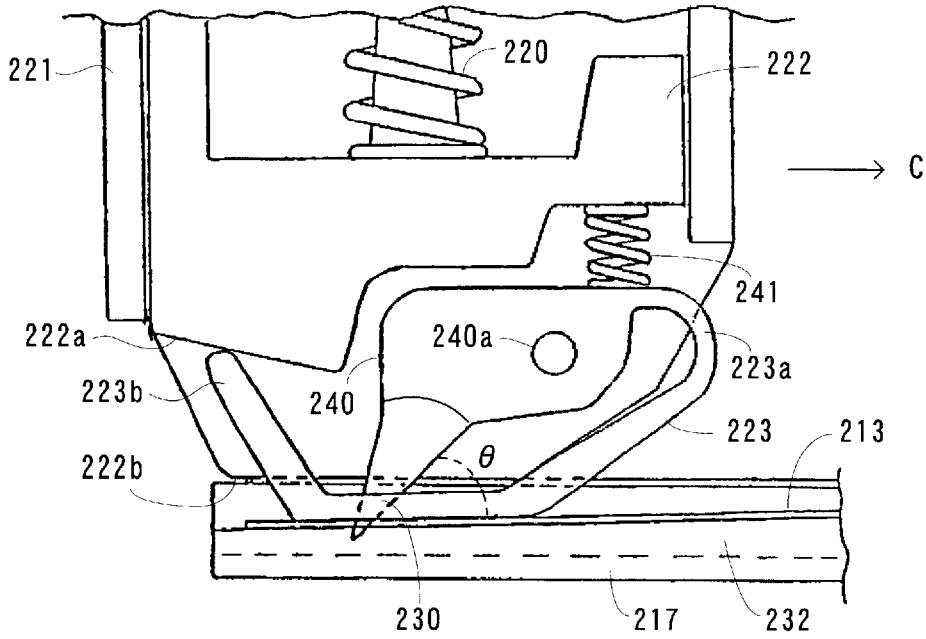
FIG. 6 is an enlarged front view of the vicinity of a cutter blade.
Figure 7:
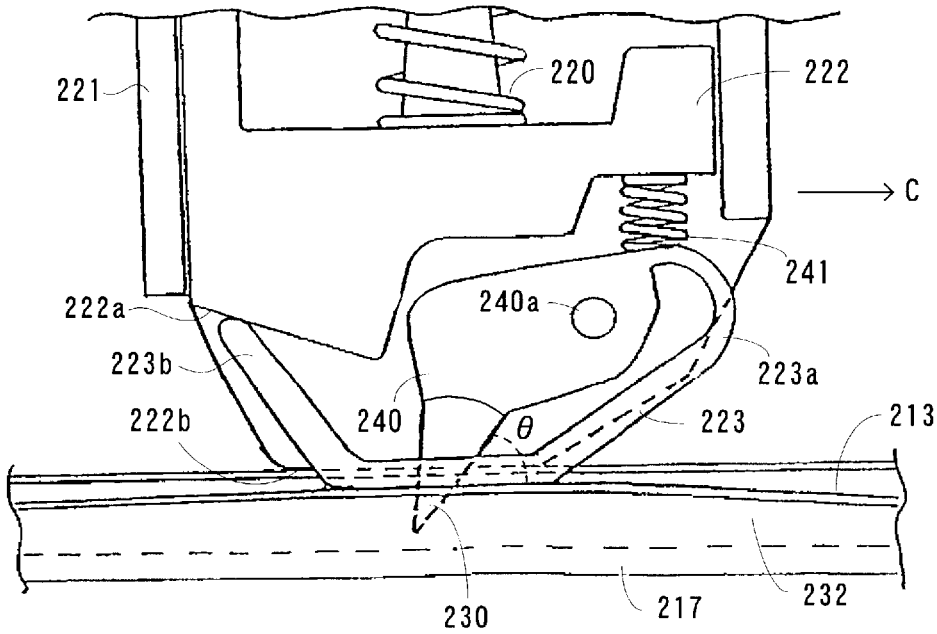
FIG. 7 is an enlarged front view of the vicinity of the cutter blade.

FIGS. 5 through 7 show a recording material cutting device of an embodiment 2 of the present invention. FIG. 5 is a front view corresponding to FIG. 3 of the embodiment 1, and FIG. 6 and FIG. 7 are enlarged front views of the vicinity of a cutter blade. In FIGS. 5 through 7, the respective elements are designated by reference numerals of 200's series, such that reference numerals having the same lower 2-digits as those in the figures showing the device of the embodiment 1 represent those mutually identical or corresponding elements. Further, there will be mainly described hereinafter the structure and functions specific to the device of the embodiment 2, and there shall be omitted the description concerning the elements which have the same structure and functions as the device of the embodiment 1.

In this embodiment 2, there is provided a cutter supporting holder 240 (corresponding to "cutter blade fixing means" recited in pertinent claims) made of plastics separately from a cutter holder 222 (corresponding to "cutter blade supporting means" recited in pertinent claims), and the cutter supporting holder 240 fixingly holds at its tip end portion a cutter blade 230. The cutter supporting holder 240 is rotatable within a substantially vertical plane about a shaft 240*a* mounted to the cutter holder 222. Formed integrally with the cutter supporting holder 240 out of the same material as the cutter supporting holder 240, via coupling portion 223*a*, is a seizing member 223 so as to have an appropriate resiliency. Identically with the embodiment 1, the side surface of the cutter blade 230 is held to be slightly inclined from a vertical plane.

As shown in FIG. 6, the device of this embodiment 2 is provided with a cutter turning spring 241 (corresponding to "turn-urging means" recited in pertinent claims) between the cutter holder 222 and the cutter supporting holder 240. The cutter turning spring 241 normally urges the cutter supporting holder 240 to turn clockwise, and this urging force is set to be smaller than the downward urging force of a cutter pressurizing spring 220. This clockwise turn is restricted by bumping a tip end portion 223*b* of the seizing member 223 formed integrally with the cutter supporting holder 240 against a bump portion 222*a* at the bottom of the cutter holder 222.

Identically with the embodiment 1, the cutter holder 222 is accommodated within a cutter case 221 in an upwardly and downwardly moveable manner, and is normally urged downwardly by the cutter pressurizing spring 220. Also, identically with the embodiment 1: a hook pawl 224 formed integrally with the cutter holder 222 engages with a recessed portion 229 provided at the upper portion of the cutter case 221 during the stand-by period of a cutter unit 212; the cutter unit 212 is moved toward the leftmost portion of the traveling region of the cutter unit 212 upon starting the cutting motion of the recording material 213 such that the hook pawl 224 is struck by a hook pawl releasing plate (not shown) and disengaged from the recessed portion 229 so that the cutter holder 222 is pushed down by the cutter pressurizing spring 220; and the cutter holder 222 having reached the end portion in the direction C is again lifted up and held by the same members as the cutter roller 125 and the roller guide 135 (see FIG. 4).

Upon the cutting motion for the recording material, the cutter holder 222 is pushed down by the cutter pressurizing spring 220 to thereby bring a flat surface 222*b* at the bottom of the cutter holder 222 to abut onto the upstream side wall of the cutter-aimed groove 131 (see FIG. 2) while interposing the recording material 213 between the flat surface 222*b* and the wall. Additionally, at the downstream side of the cutter-aimed groove 131 (see FIG. 2), the bottom of the seizing member 223 abuts onto a cammed surface of a cammed portion 232 in a state interposing the recording material 213 therebetween, by the clockwise turn urging force of the cutter turning spring 241 and the resilient force of the seizing member 223. This brings the cutter blade 230 into an appropriate depth within the cutter-aimed groove 131. Upon starting the cutting motion, the cutter blade 230 is brought into such a depth to cut the recording material by the near-tip portion of the cutter blade 230. Simultaneously therewith, the recording material 213 is tightly seized at the upstream and downstream side of the cutter blade 230, to thereby effectively prevent the recording material 213 from being twisted, creased or bent, particularly upon starting the cutting motion.

During the cutting motion for the recording material 213, the seizing member 223 abuts onto the upper surface of the cammed portion 232 in a state interposing the recording material 213 therebetween, and the whole of the cutter unit 212 travels in the left-to-right direction (direction of the arrow C) in FIG. 5. Identically with the embodiment 1, the upper surface of the cammed portion 232 is formed with such a cammed surface having a higher central portion, lower starting point side and lower ending point side.

The whole of the cutter unit 212 travels in the arrow C direction. As the height of the cammed portion 232 is gradually raised, the position of the seizing member 223 is also raised. At this time, the tip end portion 223*b* of the seizing member 223 bumps against the bump portion 222*a* to thereby restrict the movement of the tip end portion 223*b*, so that the cutter supporting holder 240 coupled to the seizing member 223 via coupling portion 223*a* is turned counterclockwise against the clockwise turn urging force of the cutter turning spring 241. This counterclockwise turn of the cutter supporting holder 240 gradually increases the cutting-in depth of the cutter blade 230 into the recording material 213.

As shown in FIG. 7, when the cutter unit 212 has reached the center of the cammed portion 232, the counterclockwise turned angle of the cutter supporting holder 240 is maximized and the cutting-in depth of the cutter blade 230 is also maximized, thereby causing the cutter blade 230 to cut the recording material 213 at the near-root portion of the cutter blade 230. As the cutter unit 212 has passed the center of the cammed portion 232 and further travels rightwardly, the cutter supporting holder 240 is gradually brought back to its original state and the cutting-in amount of the cutter blade 230 is also gradually shallowed. At the time of reaching the rightmost portion in FIG. 5, the cutter blade 230 has been brought back into a state to cut the recording material 213 at the near-tip portion of the cutter blade 230.

In this way, the cutting-in depth of the cutter blade 230 is varied along the cammed surface provided at the cammed portion 232 to thereby eventually allow to cut the recording material 213 by using the whole of the cutter blade 230, identically with the embodiment 1. However, the height difference in the cammed surface in this embodiment is made smaller than the embodiment 1, based on the following reason.

It is common to this embodiment 2 and the embodiment 1 that the up-and-down displaced range of the cutter blade depends on the height difference of the cammed surface. However, in the device of the embodiment 1, the height difference of the cammed surface directly leads to the cutting-in depth of the cutter blade, due to the structure of the device. Contrary, in this embodiment 2, the up-and-down displaced range of the cutter blade 230 is varied such as due to the distance from the shaft 240*a* to the cutter blade 230 and the shape of the coupling portion 223*a* based on the above described structure and operation, even when the height difference of the cammed surface is the same. Thus, such as suitably designing the distance from the shaft 240*a* to the cutter blade 230 and/or the shape of the coupling portion 223*a* allows to reduce the height difference of the cammed surface while obtaining the same cutting-in depth of the cutter blade as the embodiment 1.

As explained in the description of the embodiment 1, upwardly and downwardly moving the cutter blade by providing the cammed surface with the height difference allows to obtain an effect to omit a tapered rail to thereby simplify the structure of the device and to thereby prolong the service life of the cutter blade. This may rather cause such a problem that the increased height difference itself of the cammed surface deteriorates the straightness of the cut portion of the recording material.

Nonetheless, adopting the structure of this embodiment 2 allows to increase the cutting-in depth of the cutter blade even by the small height difference of the cammed surface, to thereby restrict the deterioration of the straightness of the recording material upon cutting, as compared with the situation of the embodiment 1.

In this embodiment 2, the cammed surface at the upper side of the cammed portion 232 has been formed to have the higher central portion, lower starting point side and lower ending point side, as shown in FIG. 5. However, it is possible to form the cammed surface such that one and the other of the starting point and ending point are high and low, respectively, to thereby form a simply tapered shape, or such that the high and low portions are repeated several times along the traveling path of the cutter unit. Further, the cammed portion 232 having the cammed surface has been integrated with the platen 217 or has been formed as the platen 217 itself. However, the cammed portion and the platen may be separately provided.

Embodiment 3

Figure 8:
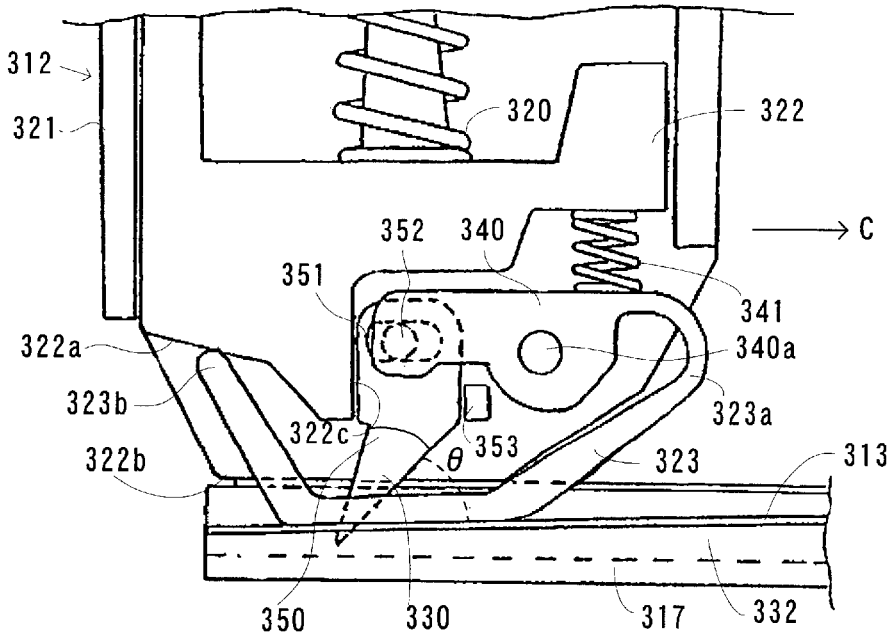
FIG. 8 is a front view of a recording material cutting device according to an embodiment 3.
Figure 9:
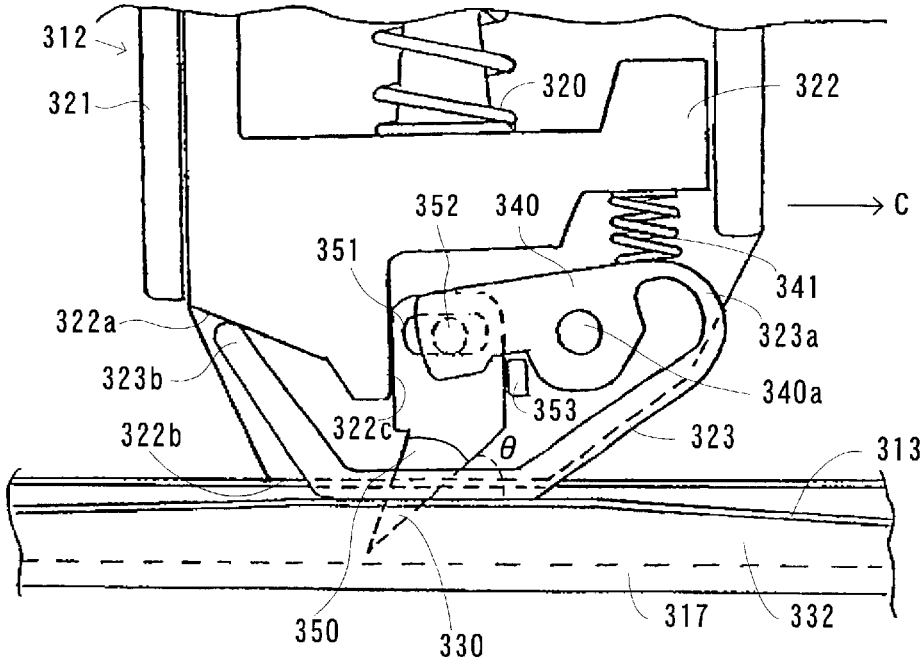
FIG. 9 is a front view of the recording material cutting device according to the embodiment 3.

FIGS. 8 and 9 show a recording material cutting device of an embodiment 3, and FIGS. 8 and 9 are front views corresponding to FIGS. 6 and 7 for the embodiment 2, respectively. In FIGS. 8 and 9, the respective elements are designated by reference numerals of 300's series, such that reference numerals having the same lower 2-digits as those in the figures showing the device of the embodiment 1 or 2 represent those mutually identical or corresponding elements. Further, there will be mainly described hereinafter the structure and functions specific to the device of the embodiment 3, and there shall be omitted the description concerning the elements which have the same structure and functions as the device of the embodiment 1 and embodiment 2.

In the embodiment 2, the cutter blade 230 have been directly mounted on the cutter supporting holder 240 which is rotatable about the shaft 240*a*, as shown in FIGS. 6 and 7. Contrary, this embodiment 3 as shown in FIGS. 8 and 9 has such a structure to fixingly hold a cutter blade 330 at a lower end portion of a cutter pressurizing holder 350 (corresponding to "cutter blade fixing means" recited in pertinent claims) and this cutter pressurizing holder 350 is coupled to a cutter supporting holder 340 (corresponding to "cutter blade translating means" recited in pertinent claims). This coupling of the cutter pressurizing holder 350 to the cutter supporting holder 340 is achieved by inserting: a projection 352 provided at the left position of the cutter supporting holder 340, so as to extend in the direction toward the reverse side of the drawing plane; into an elongated slot 351 provided at the upper portion of the cutter pressurizing holder 350.

The cutter pressurizing holder 350 is allowed to freely translate upwardly and downwardly, if not coupled to the cutter supporting holder 340. However, the up-and-down movement of the cutter pressurizing holder 350 is limited by the projection 352 inserted in the slot 351, so that the cutter pressurizing holder 350 is allowed to consonantly translate upwardly and downwardly only when the projection 352 moves upwardly and downwardly. Further, the right and left movements of the cutter pressurizing holder 350 are restricted by a side surface 322*c* of a cutter holder 322 (corresponding to "cutter blade supporting means" recited in pertinent claims) and a projection 353 provided at the cutter holder 322.

The cutter supporting holder 340 is mounted onto the cutter holder 322, in a swingable manner within a substantially vertical plane about a shaft 340*a*. The seizing member 323 is formed integrally with the cutter supporting holder 340 out of the same material as the cutter supporting holder 340, via coupling portion 323*a*, so as to have an appropriate resiliency. Identically with the device of the embodiments 1 and 2, the cutter blade 330 held at the tip end of the cutter pressurizing holder 350 is slightly inclined from a vertical plane.

As shown in FIG. 8, provided between the bottom of the cutter holder 322 and the cutter supporting holder 340 is a cutter turning spring 341 (corresponding to "turn-urging means" recited in pertinent claims) which normally urges the cutter supporting holder 340 clockwise about the shaft 340*a*. Further, the urging force of the cutter turning spring 341 is set to be smaller than the downward urging force of a cutter pressurizing spring 320 (corresponding to "urging means" recited in pertinent claims). This clockwise turn is restricted by bumping a tip end portion 323*b* of the seizing member 323 formed integrally with the cutter supporting holder 340 against a bump portion 322*a* at the bottom of the cutter holder 322.

Identically with the device of the embodiments 1 and 2, the cutter holder 322 is accommodated within a cutter case 321 in an upwardly and downwardly moveable manner, and is normally urged downwardly by the cutter pressurizing spring 320. Also, identically with the device of the embodiments 1 and 2: a hook pawl (not shown) formed integrally with the cutter holder 322 engages with a recessed portion (not shown) provided at the upper portion of the cutter case 321 during the stand-by period of a cutter unit 312; the cutter unit 312 is moved toward the leftmost portion of the traveling region of the cutter unit 312 upon starting the cutting motion of the recording material 313 such that the hook pawl is struck by a hook pawl releasing plate (not shown) and disengaged from the recessed portion so that the cutter holder 322 is pushed down by the cutter pressurizing spring 320; and the cutter holder 322 having reached the end portion in the direction C is again lifted up and held by the same members as the cutter roller 125 and the roller guide 135 (see FIG. 4).

Upon the cutting motion for the recording material, the cutter holder 322 is downwardly urged by the cutter pressurizing spring 320 to thereby bring a flat surface 322*b* at the bottom of the cutter holder 322 to abut onto the upstream side wall of the cutter-aimed groove 131 (see FIG. 2) while interposing the recording material 313 between the flat surface 322*b* and the wall. Additionally, at the downstream side of the cutter-aimed groove 131 (see FIG. 2), the bottom of the seizing member 323 abuts onto a cammed surface of a cammed portion 332 in a state interposing the recording material 313 therebetween, by the clockwise turn urging force of the cutter turning spring 341 and the resilient force of the seizing member 323. This brings the cutter blade 330 held at the tip end of the cutter pressurizing holder 350, into an appropriate depth within the cutter-aimed groove 131.

Upon starting the cutting motion, as shown in FIG. 8, the cutter blade 330 is brought into such a depth to cut the recording material by the near-tip portion of the cutter blade 330. Simultaneously therewith, the recording material 313 is tightly seized at the upstream and downstream side of the cutter blade 330, to thereby effectively prevent the recording material 313 from being twisted, creased or bent, particularly upon starting the cutting motion.

During the cutting motion for the recording material 313, the seizing member 323 abuts onto the upper surface of the cammed portion 332 in a state interposing the recording material 313 therebetween, and the whole of the cutter unit 312 travels in the left-to-right direction (direction of the arrow C) in FIG. 8. Identically with the device of the embodiments 1 and 2, the upper surface of the cammed portion 332 is formed with such a cammed surface having a higher central portion, lower starting point side and lower ending point side.

The whole of the cutter unit 312 travels in the arrow C direction. As the height of the cammed portion 332 is gradually raised, the position of the seizing member 323 is also raised. At this time, the tip end portion 323*b* of the seizing member 323 bumps against the bump portion 322*a* to thereby restrict the movement of the tip end portion 323*b*, so that the cutter supporting holder 340 coupled to the seizing member 323 via coupling portion 323*a* is turned counterclockwise against the clockwise turn urging force of the cutter turning spring 341.

This counterclockwise turn of the cutter supporting holder 340 pushes down the cutter pressurizing holder 350 coupled to the cutter supporting holder 340 via projection 352 and slot 351, to thereby gradually increase the cutting-in depth of the cutter blade 330 into the recording material 313. Further, as shown in FIG. 9, when the cutter unit 312 has reached the center of the cammed portion 332, the counterclockwise turned amount of the cutter supporting holder 340 is maximized and the cutting-in depth of the cutter blade 330 is also maximized, thereby causing the cutter blade 330 to cut the recording material 313 at the near-root portion of the cutter blade 330.

As the cutter unit 312 has passed the center of the cammed portion 332 and further travels rightwardly, the cutter supporting holder 340 is gradually brought back to its original state and the cutting-in amount of the cutter blade 330 is also gradually shallowed. At the time of reaching the rightmost portion of the traveling region, the cutter blade 330 has been brought back into a state to cut the recording material 313 at the near-tip portion of the cutter blade 330.

In this way, the cutting-in depth of the cutter blade 330 is varied along the cammed surface provided at the cammed portion 332 to thereby eventually allow to cut the recording material 313 by the whole of the cutter blade 330, identically with the device of the embodiments 1 and 2. Further, identically with the device of the embodiment 2, the height difference in the cammed surface in this embodiment 3 is made smaller than the embodiment 1, so as to allow the whole of the cutter blade 330 to cut the recording material 313 while restricting the deterioration of the straightness at the cut portion of the recording material.

Further, the recording material cutting device of this embodiment 3 has such a constitution that the upwardly and downwardly translatable cutter pressurizing holder 350 is provided separately from the cutter supporting holder 340, and the cutter blade 330 is fixed at the lower end portion of the cutter pressurizing holder 350. This allows an angle θ between the edge surface and a horizontal plane to be normally kept constant, even when the cutter supporting holder 340 is turned to thereby change the cutting-in amount of the cutter blade 330.

In the embodiment 2, the cutter blade 230 has been directly fixed to the cutter supporting holder 240, so that the cutter blade 230 is turned together with the cutter supporting holder 240 to be turned by the transition of the up-and-downness of the cammed portion 232, to thereby change the angle θ defined between the edge surface of the cutter blade 230 and a horizontal plane. The variation of the angle θ leads to the variation of the angle defined between the edge surface and the recording material. The variation of the angle defined between the edge surface and the recording material leads to the variation of the cutting manner depending on the position of the recording material, so that the stability of cutting may be lost.

Nonetheless, the constitution of the embodiment 3 renders the angle θ defined between the edge surface of the cutter blade 330 and a horizontal plane to be normally constant, so that the angle defined between the edge surface and the recording material 313 is also kept substantially constant. This keeps the cutting manner from changing depending on the position of the recording material, thereby allowing the stable cutting of the whole of the recording material.

Also, in the recording material cutting device of this embodiment 3, the cammed surface at the upper side of the cammed portion 332 has been formed to have the higher central portion, lower starting point side and lower ending point side, identically with the device of the embodiments 1 and 2. However, it is possible to form the cammed surface such that one and the other of the starting point and ending point are high and low, respectively, to thereby form a simply tapered shape, or such that the high and low portions are repeated several times along the traveling path of the cutter unit. Further, the cammed portion 332 has been integrated with the platen 317 or has been formed as the platen 317 itself. However, the cammed portion and the platen may be separately provided.

Embodiment 4

Figure 10:
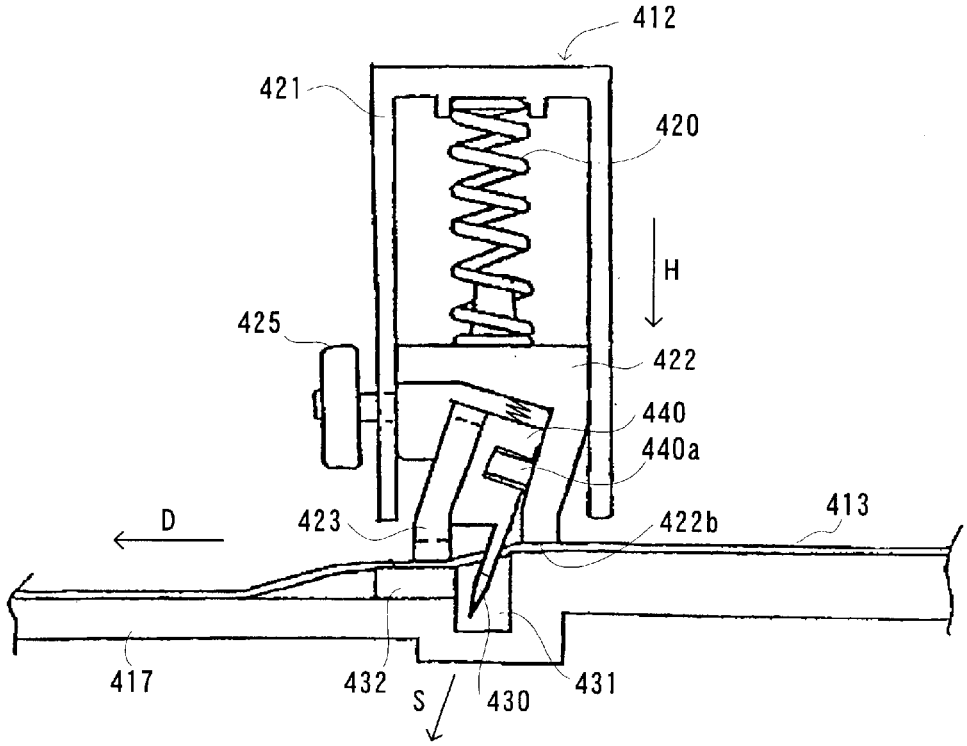
FIG. 10 is a cross-sectional view of a cutter unit of a recording material cutting device according to an embodiment 4.

FIG. 10 shows a recording material cutting device of an embodiment 4, and FIG. 10 corresponds to FIG. 2 showing the embodiment 1. In FIG. 10, the respective elements are designated by reference numerals of 400's series, such that reference numerals having the same lower 2-digits as those in the figures showing the device of the embodiments 1 through 3 represent those mutually identical or corresponding elements. Further, there will be mainly described hereinafter the structure and functions specific to the device of the embodiment 4, and there shall be omitted the description concerning the elements which have the same structure and functions as the device of the embodiments 1 through 3.

In each of the device of the embodiments 1 through 3, the cutter blade has been mounted such that its side surface is inclined from the vertical plane toward the upstream side in the recording material transferring direction. This is to improve the entering ability of the cutter blade upon starting the cutting to thereby prevent the recording material from being twisted, creased or bent, as already explained. Further, in each of the aforementioned embodiments, there has been provided the mechanism for changing, while the cutter unit travels from the starting point toward the ending point, the relative height between: the recording material; and the cutter holder 122 (embodiment 1), cutter supporting holder 240 (embodiment 2) or cutter pressurizing holder 350 (embodiment 3) for holding the cutter blade; so as to cut the recording material by using the whole of the cutter blade to thereby prolong the service life of the cutter blade.

However, when the cutter holder 122 (embodiment 1), cutter supporting holder 240 (embodiment 2) or cutter pressurizing holder 350 (embodiment 3) for holding the cutter blade is merely moved upwardly and downwardly in a state where the side surface of the cutter blade is inclined from the vertical plane, the cutting position of the recording material in the transferring direction (direction D) in cutting by the near-tip portion of the cutter blade (i.e., in case of a shallow cutting-in depth) becomes different from that in cutting by the near-root portion of the cutter blade (i.e., in case of a deep cutting-in depth). As such, the cut portion of the recording material is brought to be not straight but slightly curved, in a strict sense.

Thus, this embodiment 4 shown in FIG. 10 includes: a cutter blade 430 fixed to a cutter supporting holder 440 corresponding to the cutter supporting holder 240 (see FIGS. 6 and 7) in the device of the embodiment 2, without inclining the side surface of the cutter blade 430 relative to the cutter supporting holder 440; and a cutter holder 422 having a shaft 440*a* inclinedly mounted to the cutter supporting holder 440 as shown in FIG. 10. As a result, the side surface of the cutter blade 430 is slightly inclined toward the upstream side in the transferring direction (direction D) of a recording material 413 as shown in FIG. 10, to thereby provide such a turning-aimed plane for the cutter supporting holder 440, which plane is perpendicular to the drawing plane of FIG. 10 and which plane includes an arrow S. This degree of the inclination shall be the same as the inclination in fixing the cutter blade to the holder in each of the embodiments 1 through 3.

By adopting such a mechanism, the moving direction of the cutter blade 430 is kept parallel to the side surface thereof, even when the cutter supporting holder 440 is turned to thereby increase the cutting-in depth of the cutter blade 430. Thus, the cutting position of the recording material in the transferring direction (direction D) in cutting by the near-tip portion of the cutter blade 430 (i.e., in case of a shallow cutting-in depth) becomes substantially the same as that in cutting by the near-root portion of the cutter blade 430 (i.e., in case of a deep cutting-in depth). This enables to effectively restrict the deterioration of the straightness of the cut portion of the recording material 413.

The recording material cutting device of this embodiment 4 has been related to the situation for providing the cutter supporting holder 440 corresponding to the cutter supporting holder 240 (see FIGS. 6 and 7) in the device of the embodiment 2, in an inclined manner. However, there can be obtained the same functions and effects, by simply mounting the cutter supporting holder 340 and the cutter pressurizing holder 350 (see FIGS. 8 and 9) in the device of the embodiment 3 in an inclined manner by an appropriate angle identically with this embodiment 4.

Embodiment 5

Figure 11:
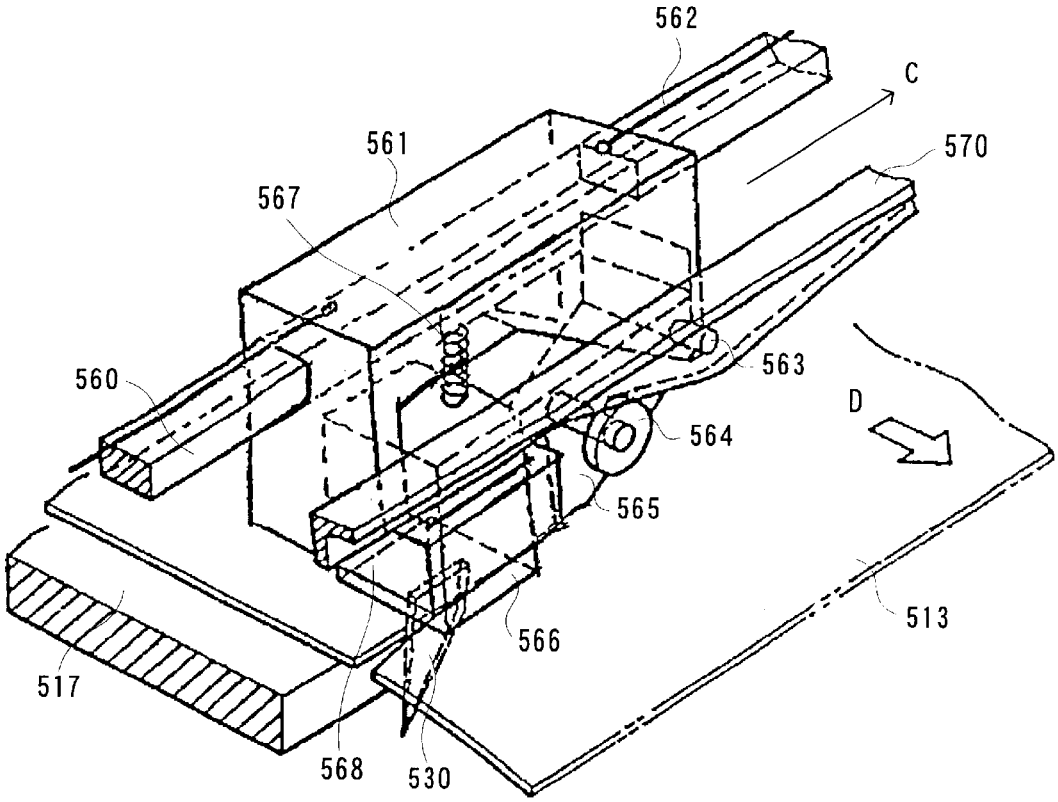
FIG. 11 is a perspective view of a recording material cutting device according to an embodiment 5.
Figure 12:
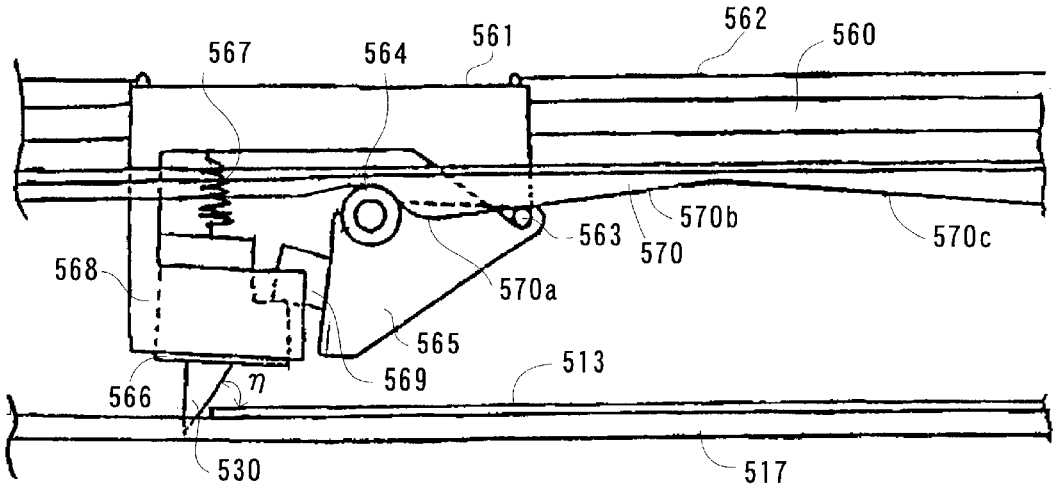
FIG. 12 is a front view from a downstream side of the recording material cutting device according to the embodiment 5.
Figure 13:
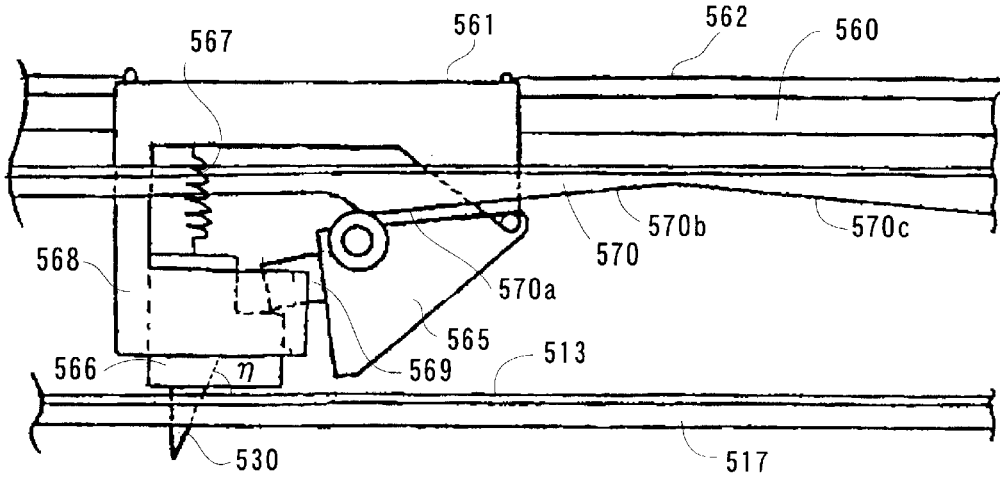
FIG. 13 is a front view from a downstream side of the recording material cutting device according to the embodiment 5.

FIGS. 11 through 13 show a recording material cutting device of an embodiment 5. FIG. 11 is a perspective view showing those pertinent portions of the recording material cutting device of the embodiment 5 in an image-forming apparatus, FIG. 12 is a front view of the recording material cutting device of FIG. 11 viewed from a downstream side in the transferring direction (direction D), and FIG. 13 is also a front view of the recording material cutting device viewed from a downstream side in the transferring direction (direction D). Differently from the device of the above described embodiments 1 through 4, the device of the embodiment 5 is of a type for upwardly and downwardly moving a cutter blade by making use of a cutter rail. In FIGS. 11 through 13, the respective elements are designated by reference numerals of 500's series, such that reference numerals having the same lower 2-digits as those in the figures showing the embodiments 1 through 4 represent those mutually identical or corresponding elements.

As shown in FIG. 11, there is transferred a recording material 513 in the direction D on a platen 517 by transferring means (not shown). Thus, the direction D is the downstream side and the opposite direction is the upstream side. Installed above the recording material 513 is a guiding rail 560 in a direction perpendicular to the direction D, i.e., in the widthwise direction of the recording material 513. The guiding rail 560 is mounted with a cutter base 561 slidable thereon. The cutter base 561 has its right and left portions fixed with driving wires 562. Driving the wires 562 by driving means (not shown) allows to reciprocally travel the cutter base 561 along the guiding rail 560.

Provided at the lower right side of the cutter base 561 (corresponding to "cutter blade traveling means" recited in pertinent claims) is a cutter arm 565 (corresponding to "swinging means" recited in pertinent claims) which is swingable about a pin 563. The cutter arm 565 is provided with a rotatable guiding roller 564 (corresponding to "guiding member" recited in pertinent claims). Further, provided at the lower left side of the cutter base 561 is a cutter holder 566 (corresponding to "cutter blade fixing means" recited in pertinent claims) having its lower end portion holding a cutter blade 530, such that the cutter holder 566 is allowed to translate upwardly and downwardly by a guiding portion 568. The cutter holder 566 is normally urged upwardly by a spring 567 (corresponding to "urging means" recited in pertinent claims) mounted above the cutter holder 566. Provided at that tip end portion of the cutter arm 565 opposite to the pin 563 is a projection 569 placed on a right shoulder portion of the cutter holder 566. Based on the same reason as the embodiments 1 through 3, the cutter blade 530 is fixed to the lower end portion of the cutter holder 566 such that the side surface of the cutter blade is inclined downstream by a predetermined angle in the transferring direction (direction D).

As shown in FIG. 11, installed separately from and parallelly to the guiding rail 560 is a cutter rail 570 (corresponding to "rail means" recited in pertinent claims). The cutter holder 566 is upwardly urged by the spring 567 as described above, to thereby lift up the cutter arm 565 via projection 569 placed on the shoulder portion of the cutter holder 566. As a result, the guiding roller 564 provided at the cutter arm 565 abuts onto the lower surface of the cutter rail 570.

As shown in FIG. 12, the lower surface of the cutter rail 570 is formed with cammed surfaces 570*a*, 570*b*, 570*c* having heights varying along the longitudinal direction of the cutter rail 570. The height of the pertinent cammed surface determines the vertical position of the cutter arm 565, thus of the cutter holder 566. Thus, as the cutter base 561 travels along the guiding rail 560, the vertical position of the cutter holder 566 is changed to thereby change the vertical position of the cutter blade 530 mounted to the lower portion of the cutter holder 566. In this embodiment 5, the lower surface of the cutter rail 570 has been formed with the cammed surfaces as shown in FIGS. 12 and 13. However, it is possible to adopt different cammed surfaces, such as having a simple upward or downward taper shape, or having repeated up-and-downness.

FIG. 12 shows a state where the cutter base 561 has reached a position just before the cutting position for a recording material. Upon starting the cutting motion for the recording material, the cutter base 561 starts traveling toward the right (direction C) in FIG. 12. Then, the guiding roller 564 firstly abuts onto the uppermost portion of the cammed surface 570*a* and is then lowered along the inclination of the cammed surface 570*a*. Simultaneously therewith, the cutter arm 565 is turned counterclockwise so that the projection 569 provided at the tip end of the cutter arm 565 pushes down the cutter holder 566 against the upward urging force of the spring 567, to thereby gradually increase the cutting-in amount of the cutter blade 530 into the recording material 513. FIG. 13 shows a state where the cutting-in depth has been just maximized so that the recording material 513 is cut by the near-root portion of the cutter blade 530.

When the cutter base 561 further travels in the direction C such that the guiding roller 564 passes through the cammed surface 570*a*, the guiding roller 564 is gradually raised along the inclined surface of the cammed surface 570*b*. Simultaneously therewith, the cutter arm 565 is gradually turned clockwise, so that the cutter holder 566 is raised by the upward urging force of the spring 567. Parallelly thereto, the cutting-in amount of the cutter blade 530 into the recording material 513 is shallowed and the cutter blade 530 is brought into a state to cut the recording material 513 at the near-tip portion of the cutter blade. Thereafter, the cutter base 561 further travels in the direction C such that the guiding roller 564 is gradually lowered along the inclined surface of the cammed surface 570*c*, so that the cutter arm 565 is gradually turned counterclockwise to thereby push down the cutter holder 566 against the upward urging force of the spring 567.

In the device of the embodiment 5, the cutter holder 566 is provided separately from the turning cutter arm 565 when the cutter holder 566 is moved upwardly and downwardly by the travel of the cutter base 561, so that the cutter holder 566 is not turned like the cutter arm 565 but simply translated upwardly and downwardly. This keeps an angle $\eta$ constant before and after the lowering of the cutter blade 530, which angle $\eta$ is defined between the edge surface of the cutter blade 530 and the surface of the recording material 513. As a result, the way to cut the recording material 513 is unchanged even depending on the position of the cutter base 561 as explained in the description of the embodiment 3, thereby allowing the stable cutting throughout the recording material. Further, the service life of the cutter blade 530 is prolonged because the whole of the cutter blade 530 is used to cut the recording material 513, similarly to the above embodiments.

Embodiment 6

Figure 14:
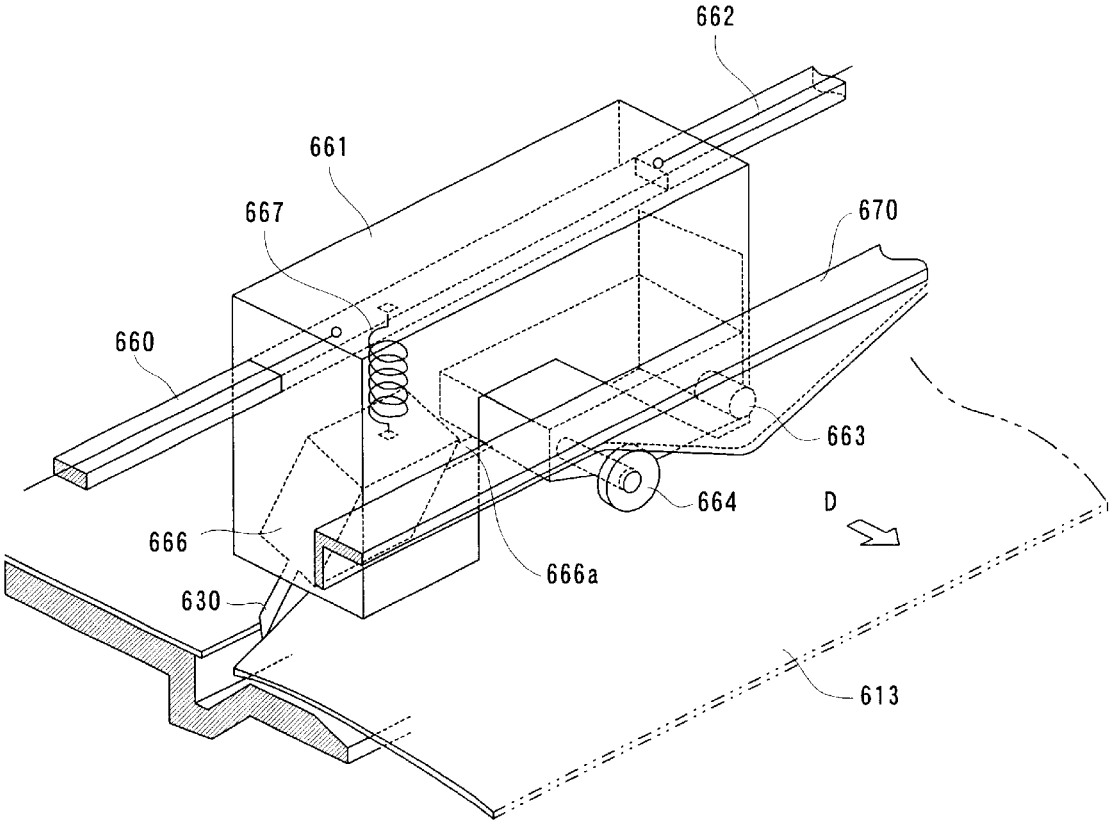
FIG. 14 is a perspective view of a recording material cutting device according to an embodiment 6.
Figure 15:
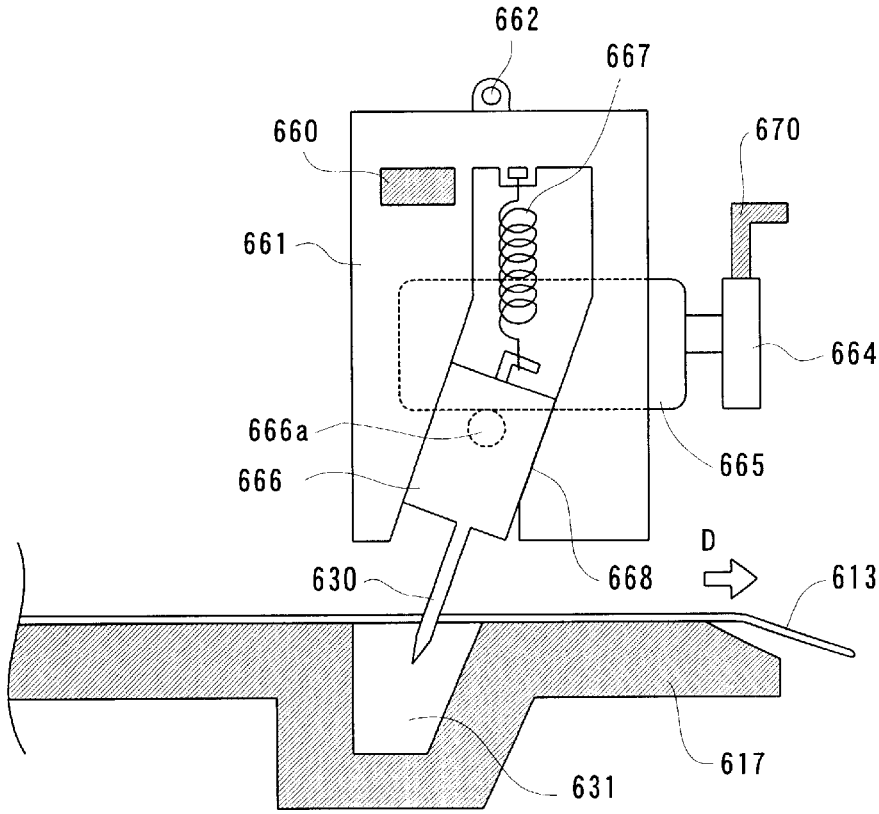
FIG. 15 is a cross-sectional view of the recording material cutting device according to the embodiment 6, taken along, at a cutter blade portion, a vertical plane including a straight line parallel to an arrow D in FIG. 14.

FIGS. 14 and 15 show a recording material cutting device of an embodiment 6. FIG. 14 is a perspective view showing those pertinent portions of the recording material cutting device of the embodiment 6 in an image-forming apparatus, and FIG. 15 is a cross-sectional view of the recording material cutting device taken along, at a cutter blade portion, a vertical plane including a straight line parallel to an arrow D in FIG. 14. Similarly to the device of the embodiment 5, the device of the embodiment 6 is of a type to upwardly and downwardly move a cutter blade by a cutter rail. In FIGS. 14 and 15, the respective elements are designated by reference numerals of 600's series, such that reference numerals having the same lower 2-digits as those in the figures showing the embodiments 1 through 5 represent those mutually identical or corresponding elements. Further, there will be mainly described hereinafter the structure and functions specific to the device of the embodiment 6, and there shall be omitted the description concerning the elements which have the same structure and functions as the device of the embodiment 5, for example.

Note, although the devices of the embodiment 6 and the following embodiment include a cutter blade inclined in the direction opposite to that in the aforementioned embodiments, there can be achieved the same effect to avoid that the recording material is twisted or creased upon starting the cutting.

In the recording material cutting device of the embodiment 5, as described above, the cutter holder 566 has been provided separately from the cutter arm 565 to thereby allow the cutter blade 530 to translate upwardly and downwardly even when the cutter arm 565 is turned. Further, to improve the entering ability of the cutter blade 530 into the recording material upon starting the cutting, the cutter blade 530 has been held to the lower end portion of the cutter holder 566 such that the side surface of the cutter blade is inclined downstream by a predetermined angle in the transferring direction (direction D), similarly to the device of the embodiments 1 through 3.

However, when the cutter holder 566 for holding the cutter blade 530 is moved upwardly and downwardly in a state where the side surface of the cutter blade is inclined from the vertical plane, the cutting position of the recording material in the transferring direction (direction D) in cutting by the near-tip portion of the cutter blade (i.e., in case of a shallow cutting-in depth) becomes different from that in cutting by the near-root portion of the cutter blade (i.e., in case of a deep cutting-in depth). As such, the cut portion of the recording material is problematically brought to be not straight but slightly curved, in a strict sense.

Thus, similarly to the device of the embodiment 4, the embodiment 6 shown in FIGS. 14 and 15 includes a cutter blade 630 fixed to a lower end portion of a cutter holder 666, without inclining the side surface of the cutter blade 630 relative to the cutter holder 666. The cutter holder 666 holding the cutter blade 630 is mounted to a cutter base 661 in a state inclined in the transferring direction (direction D) by a predetermined angle from a vertical plane. Further, this cutter holder 666 is allowed to move upwardly and downwardly by a guiding portion 668, along the plane parallel to the side surface of the cutter blade 630. The degree of the inclination of the cutter base 661 is equalized to the inclined angle of the fixed cutter blade in the embodiment 5.

The cutter holder 666 is urged upwardly by a spring 667, and the upward movement of the cutter holder 666 is limited such that the cutter holder 666 is provided with a projection 666*a* which is abutted onto an arm 665 coupled to a guiding roller 664 which strikes a cammed surface at a lower side of a cutter rail 670. As the cutter base 661 travels along a guiding rail 660 so that the guiding roller 664 is moved upwardly and downwardly along the cammed surface of the cutter rail 670, the cutter holder 666 is also moved within a plane parallel to the side surface of the cutter blade 630.

By adopting such a mechanism, the cutting position of the recording material in the transferring direction (direction D) in cutting by the near-tip portion of the cutter blade 630 (i.e., in case of a shallow cutting-in depth) is unchanged from that in cutting by the near-root portion of the cutter blade 630 (i.e., in case of a deep cutting-in depth). This enables to effectively restrict the deterioration of the straightness of the cut portion of the recording material 613.

Embodiment 7

Figure 16:
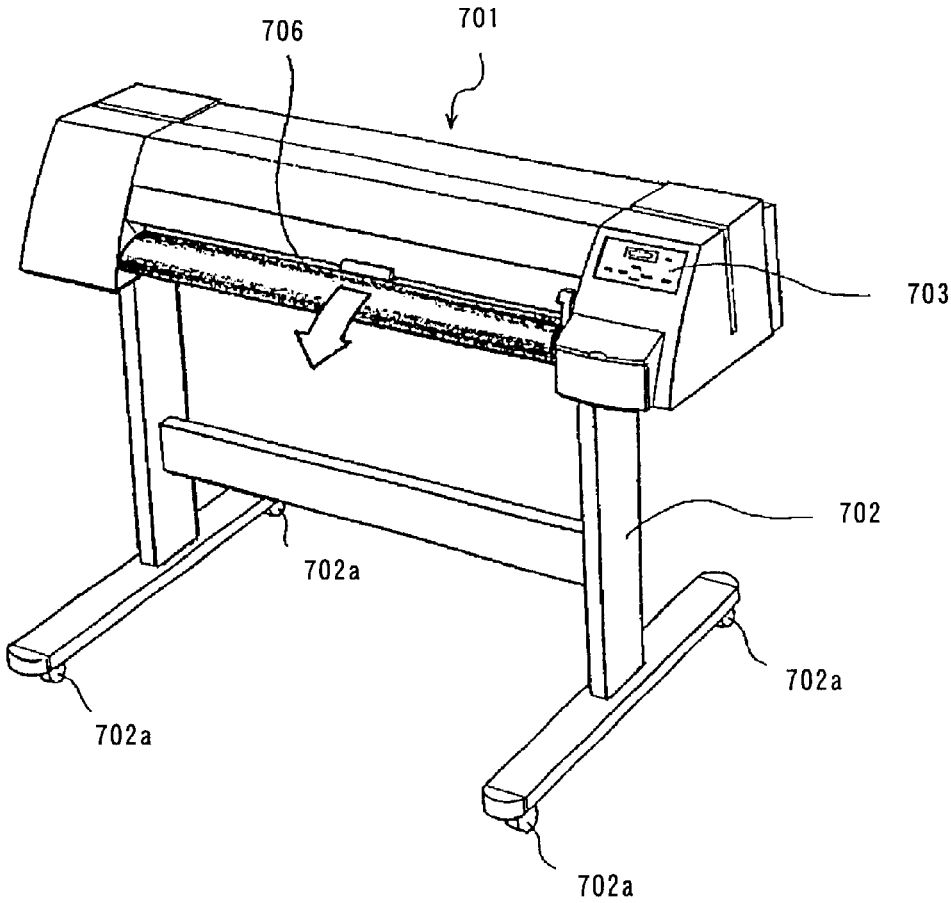
FIG. 16 is a diagonally front perspective view of the whole of an image-forming apparatus (color plotter) provided with a recording material cutting device according to an embodiment 7.
Figure 17:
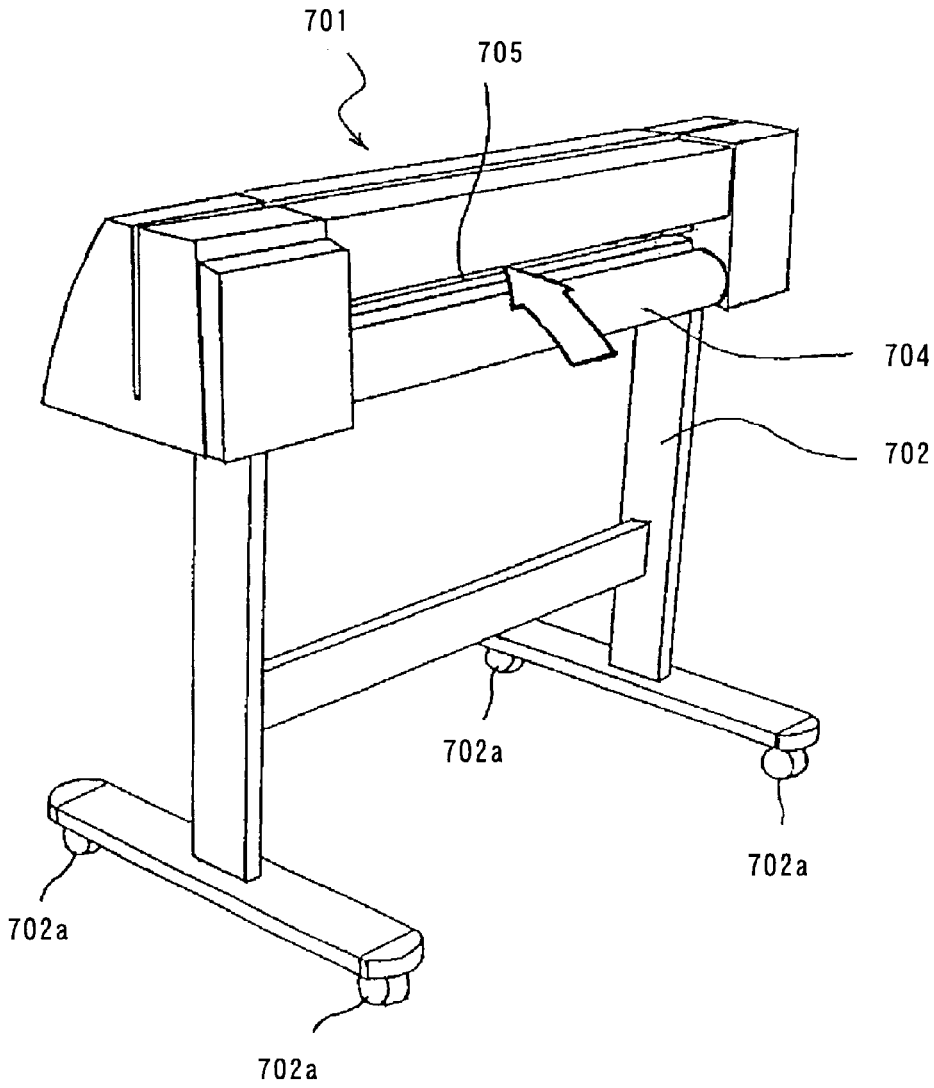
FIG. 17 is a diagonally rear perspective view of the whole of the color plotter of FIG. 16.
Figure 18:
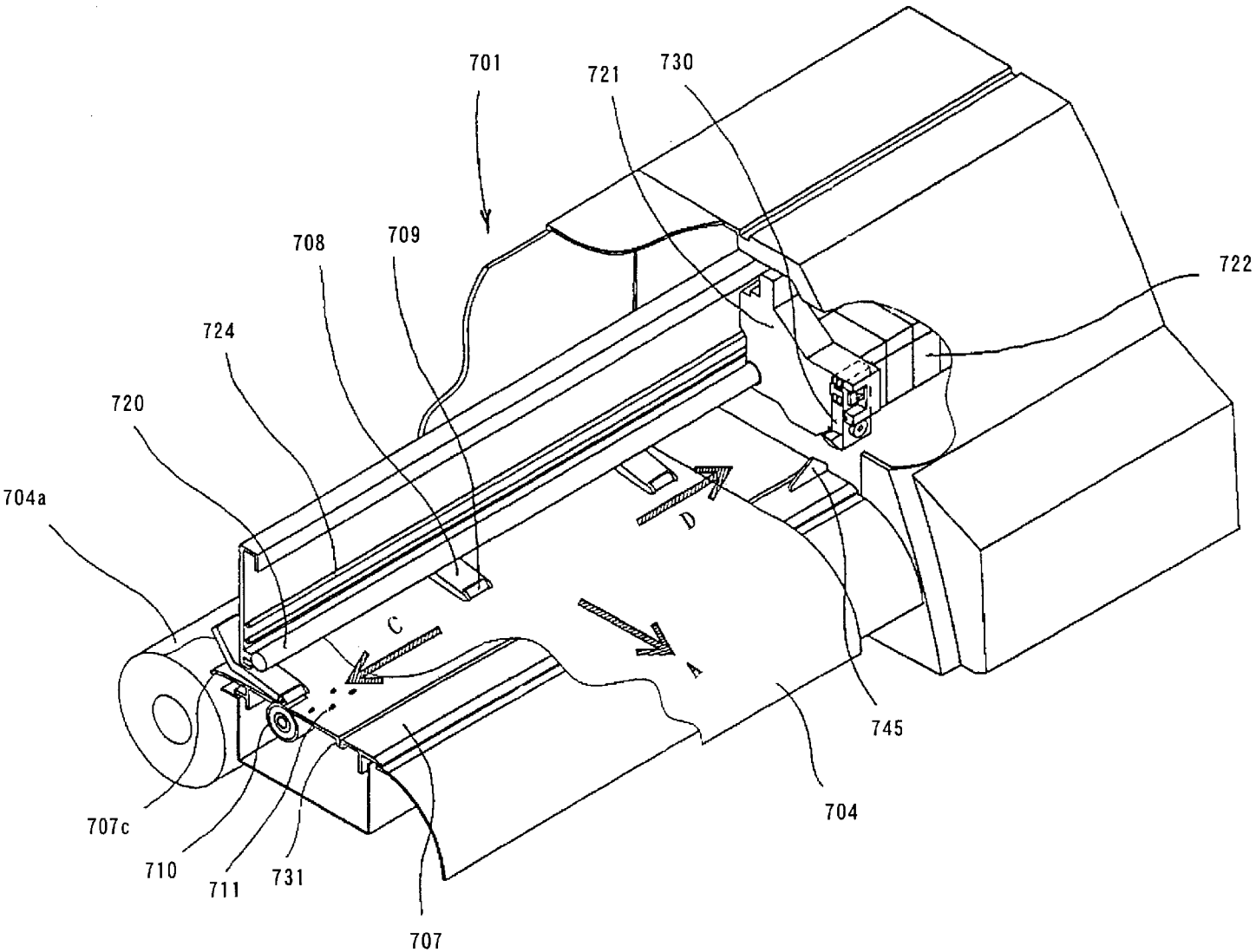
FIG. 18 is a partially cut-away perspective view precisely showing the color plotter shown in FIG. 16 and FIG. 17.

There will be described hereinafter a recording material cutting device of an embodiment 7. FIG. 16 is a diagonally front perspective view of the whole of a color plotter (or merely "plotter") as one type of image-forming apparatus, FIG. 17 is a diagonally rear perspective view of the whole of the color plotter of FIG. 16, and FIG. 18 is a partially cut-away perspective view precisely showing the color plotter shown in FIG. 16 and FIG. 17. This color plotter is of a type to use a rolled paper as a recording material, and is provided with the recording material cutting device of the embodiment 7 for cutting the rolled paper.

Reference numeral 701 designates a plotter fixed at an upper portion of a stand 702, at an easy-to-use height. Provided at the bottom of the stand 702 are casters 702*a*, thereby allowing to readily move the plotter 701. Provided at a controlling part 703 are various switches for controlling the plotter 701, so that users are to use the switches to thereby input instructions such as a size of paper, switching of online/offline and various commands.

Set at the rear bottom portion of the plotter 701 is a roll 704*a* of a recording material 704, such that the recording material 704 drawn out from the roll 704*a* is inserted into an arrow direction shown in FIG. 17 via insertion slot 705. The recording material 704 inserted into the plotter 701 is color printed based on the controlling instructions from the controlling part 703 upon passing through an image forming area to be described later, and then fed out in an arrow direction in FIG. 16 via front side feeding slot 706.

There will be described hereinafter a transferring operation of a recording material, and an image forming operation (printing operation), for example, with reference to FIG. 18. The recording material 704 inserted via rear side insertion slot 705 (see FIG. 17) is passed on a paper-feed guiding portion 707*c* of a platen 707, and is transferred in a state clamped between: pinch rollers 709 rotatably mounted at tip ends of rotatable pinch roller arms 708, respectively; and a scanning roller 710; so as to pass through the image forming area. The plotter 701 is provided with an inner fan rotating in a direction to suck air via sucking holes 711 provided at the platen 707. The recording material 704 is transferred, while sucked to the surface of the platen 707 by an appropriate sucking force caused by such rotation of the fan.

Installed above the platen 707 is a guiding rail 720 in the widthwise direction of the recording material 704, and the guiding rail 720 is mounted with a carriage 721 capable of reciprocating between opposite ends of the guiding rail 720. FIG. 18 shows a state where the carriage 721 has been brought to a rightmost end portion of the guiding rail 720. The carriage 721 is fixed with a wire 724 stretched parallelly to the guiding rail 720. When the wire 724 is driven in a direction C or direction D by normally rotating or reversely rotating a carriage driving motor (not shown), the carriage 721 is moved in the direction C or direction D along the guiding rail 720.

The carriage 721 has a head holder 722 mounted with print heads 723. Those print heads 723 are provided for colors required for color printing, and the print heads 723 contain ink of respective colors (such as cyan, magenta, yellow, and black). The image forming area is established by that area through which the print head 723 passes on the platen 707 when the carriage 721 reciprocates.

The image formation is conducted when the carriage 721 is moved and the print heads 723 inject ink toward the recording material 704 in the image forming area just below the print heads 723. In forming an image on the recording material 704, the recording material 704 is temporarily stopped to thereby conduct printing of 1 band, and upon completion of the printing of 1 band, the recording material 704 is transferred by a predetermined length to thereby print the next band. There is formed one piece of image, by repeating such an operation, that number of times which corresponds to the number of bands for the image to be printed.

Upon completion of printing of one piece of image, the recording material 704 is cut by a recording material cutting device 730 according to the present invention. As shown in FIG. 18, the recording material cutting device 730 is mounted at a slightly downstream side position (direction A side) in the recording material transferring direction, relative to the head holder 722 of the carriage 721. Generally, the cutting motions for the recording material 704 are classified into: a motion for downwardly protruding a cutter blade housed in the recording material cutting device 730 to thereby insert the cutter blade into a cutter-aimed groove 731 provided at the platen 707; a motion for moving the carriage 721, in a state where the cutter blade is inserted in the cutter-aimed groove 731, from the leftmost end portion in FIG. 18 in a direction indicated by an arrow D to thereby cut the recording material 704; and a motion for housing the cutter blade into the recording material cutting device 730 again after completing the cutting.

There will be described hereinafter the structure and cutting motion of the recording material cutting device 730 according to the embodiment 7. Each of FIGS. 19 through 22 is a view (partially cut-away front view) of the recording material cutting device 730 viewed from a downstream side of the transferring direction of the recording material 704. Further, FIG. 23 is a side view of the recording material cutting device 730 viewed from the left side of FIG. 19 through FIG. 22, and FIG. 24 is a front view for explaining a member provided at an upper portion of a holder 743 so as to engage with the carriage 721.

Figure 23:
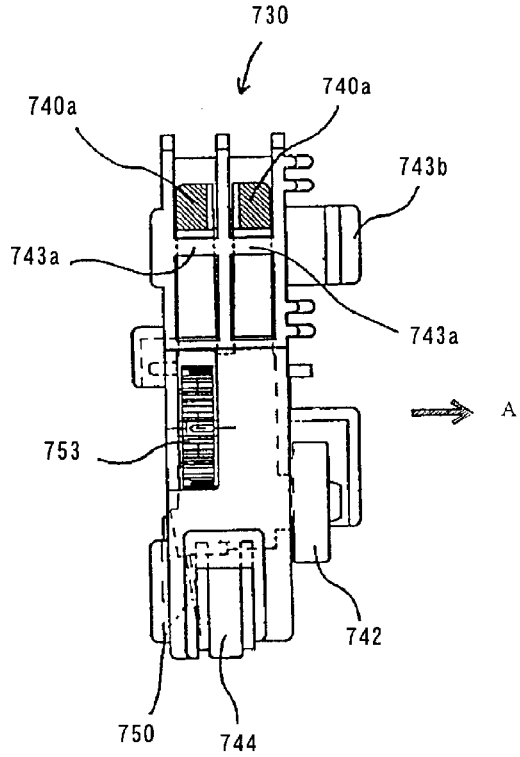
FIG. 23 is a side view of the recording material cutting device viewed from the left side of FIG. 19 through FIG. 22.
Figure 24:
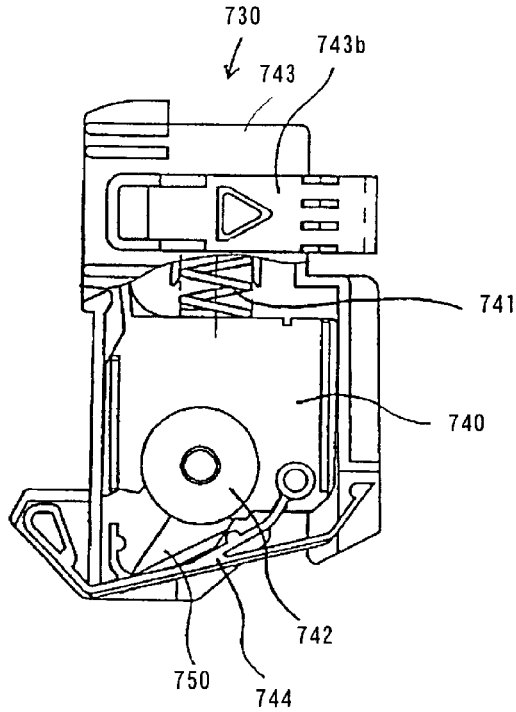
FIG. 24 is a front view for explaining a member provided at an upper portion of a holder so as to engage with a carriage.

As shown in FIGS. 23 and 24, provided at the upper portion of the holder 743 is an engaging member 743*b* integrally with the holder 743. As shown in FIG. 18, this engaging member 743*b* allows the recording material cutting device 730 to be readily mounted onto the carriage 721 and to be readily dismounted from the carriage 721.

As shown in FIGS. 19 through 22, the recording material cutting device 730 is constituted to include: a cutter slider 740 (corresponding to "accommodating means" recited in pertinent claims); a guiding roller 742 rotatably mounted to the cutter slider 740; the holder 743 (corresponding to a part of "traveling means" recited in pertinent claims) which contains the cutter slider 740 therein and which is mountable to the carriage 721; and a spring 741 (corresponding to "urging means" recited in pertinent claims) located between the upper portion of the cutter slider 740 and the holder 743 to thereby urge the cutter slider 740 downwardly (direction F). Note, in FIGS. 19 through 22, there are omitted members at this side of the holder 743, so as to clarify the inner state of the holder 743.

As shown in FIGS. 19 through 22, the spring 741 has: an upper end portion accommodated in a spring accommodating portion within the holder 743, and a lower end portion inserted with an elongated projection 740*b* (see FIGS. 27 through 30) provided at the upper portion of the cutter slider 740. This restricts the lateral movement of the spring 741, while allowing only the vertical expanding and contracting motion of the spring 741.

Further, as shown in FIGS. 25 through 28 to be described later, provided within the cutter slider 740 are: a blade slider 751 (corresponding to "holding means" recited in pertinent claims) mounted with a cutter blade 750 (corresponding to a "cutter blade" recited in pertinent claims); a leaf spring 752 (corresponding to "second urging means" recited in pertinent claims) for upwardly urging the blade slider 751 within the cutter slider 740; and a dial 753 (corresponding to "changeover means" recited in pertinent claims) for adjusting the vertical position of the blade slider 751 within the cutter slider 740.

Note, in the recording material cutting device 730 of the embodiment 7, the whole of the blade slider 751 is replaced without replacing the cutter blade 750 only, such as when the cutter blade 750 has been broken or the cutter blade 750 has finished the service life. This allows those users unfamiliar with the usage of the recording material cutting device to safely conduct the replacing operation.

Figure 19:
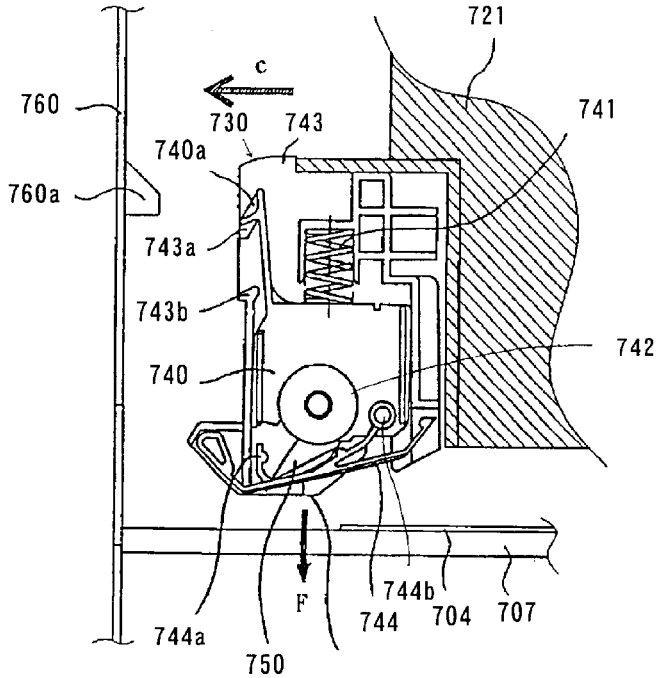
FIG. 19 is a view (front view) of the recording material cutting device viewed from a downstream side of the transferring direction of a recording material 704.

FIG. 19 shows a situation during which no cutting motions are conducted. Then, as shown in FIG. 19 and FIG. 23, two hooking members 740*a* provided integrally with the cutter slider 740 are hooked to associated members 743*a* provided at the holder 743. Thus, the cutter slider 740 is held at an upper position within the holder 743, against the downward (direction F) urging force by the spring 741.

Figure 20:
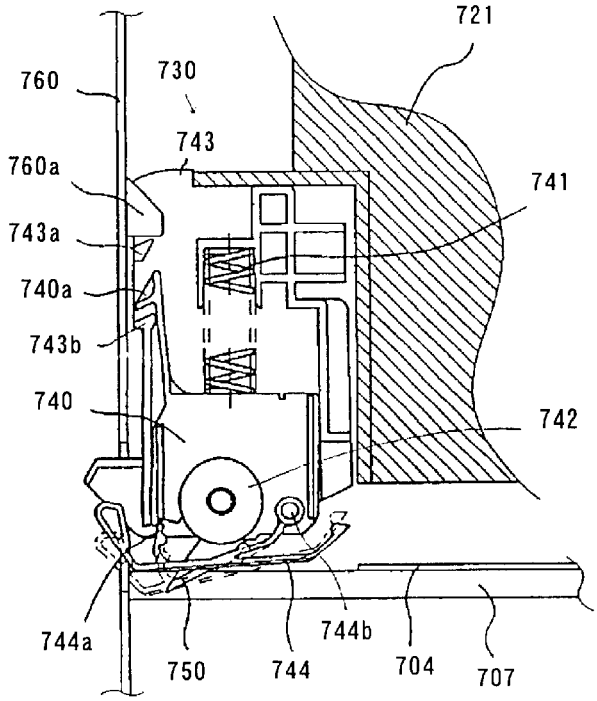
FIG. 20 is a view (front view) of the recording material cutting device viewed from a downstream side of the transferring direction of the recording material 704.

When the plotter 701 receives an instruction from the controlling part 703 to cut the recording material 704, the carriage 721 is firstly moved in the direction C along the guiding rail 720, to thereby reach the left end of the moveable region. FIG. 20 shows this situation. Provided at the left end of the guiding rail 720 is a hook releasing plate 760. When the carriage 721 mounted with the recording material cutting device 730 reaches the left end of the guiding rail 720, the hooking members 740*a* are struck by hook releasing ribs 760*a* of the hook releasing plate 760 so that the hooking members 740*a* are disengaged from the members 743*a* provided at the holder 743.

When the hooking members 740*a* are disengaged from the members 743*a*, the cutter slider 740 having been downwardly urged by the spring 741 is instantaneously lowered. Relatedly, when the hooking members 740*a* are disengaged from the members 743*a* in a state where the recording material cutting device 730 is dismounted from the carriage 721, the cutter slider 740 is lowered by the spring 741 until the hooking members 740*a* are hooked to members 743*b* provided at the holder 743. However, when the recording material cutting device 730 has been mounted to the carriage 721, the seizing member 744 (corresponding to "seizing means" recited in pertinent claims) provided at the lower end of the cutter slider 740 abuts onto the upper portion of a downstream side wall of the cutter-aimed groove 731 (see FIG. 33 to be described later) before the hooking members 740*a* are hooked to the members 743*b*, to thereby stop the lowering of the cutter slider 740.

At this time, the downward urging force to the cutter slider 740 based on the spring 741 is received by such an action that the seizing member 744 yields about 744*b* so that a bump portion 744*a* provided at the seizing member 744 bumps against the lower end portion of the cutter slider 740. When the seizing member 744 is further artificially pushed upwardly in the state where the bump portion 744*a* is struck against the lower end portion of the cutter slider 740, the spring 741 yields and the cutter slider 740 is lifted up within the holder 743. This also lifts up the blade slider 751, cutter blade 750 and leaf spring 752 which are housed within the cutter slider 740, together with the cutter slider 740.

When the seizing member 744 yields so that the bump portion 744*a* is struck by the lower end portion of the cutter slider 740, the tip portion of the cutter blade 750 downwardly protruded beyond the seizing member 744 of this state is brought into the cutter-aimed groove 731 (see FIG. 18) provided in the platen 707 upon the cutting operation. Moving the carriage 721 in this state along the guiding rail 720 in the direction D (rightward direction in FIGS. 19 through 22) cuts the recording material 704 placed on the platen 707. At this time, the seizing member 744 assuredly seizes the recording material 704, thereby enabling to avoid that the recording material 704 is buckled or bent upon starting the cutting. The amount of the cutter blade 750 downwardly protruding beyond the seizing member 744 (protruding amount) can be adjusted by the method to be described later.

Note, while cutting the recording material 704, the seizing member 744 abuts onto the upper portion of a downstream side wall 707*a* (cammed portion) of the cutter-aimed groove 731, with clamping the recording material 704 between such an upper portion and the seizing member 744. Further, the cutter blade 750 is designed to come close to an upstream side wall 707*b* within the cutter-aimed groove 731 (see FIG. 33 to be described later). Thus, the recording material 704 is cut by that region of the cutter blade 750, which is positioned at the substantially same level or height as the upper portion of the upstream side wall 707*b* of the cutter-aimed groove 731.

Figure 21:
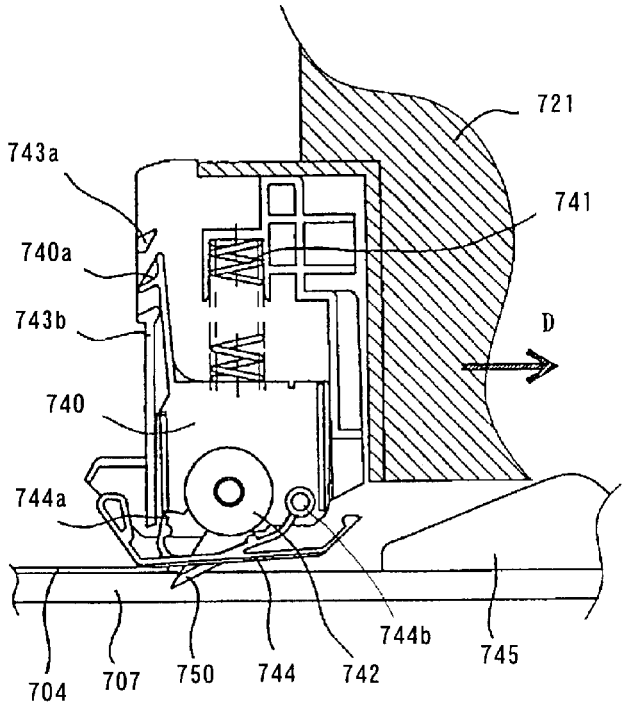
FIG. 21 is a view (front view) of the recording material cutting device viewed from a downstream side of the transferring direction of the recording material 704.
Figure 22:
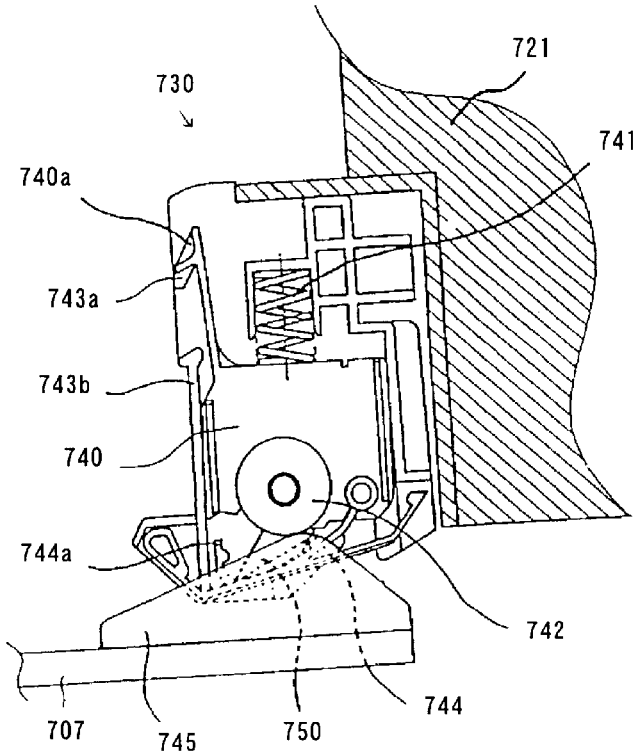
FIG. 22 is a view (front view) of the recording material cutting device viewed from a downstream side of the transferring direction of the recording material 704.

Provided at the right end of the travelable range of the carriage 721 is a guiding rib 745 (see FIG. 18, FIG. 21 and FIG. 22). When the recording material cutting device 730 having finished cutting the recording material 704 has reached this position of the guiding rib 745, the guiding roller 742 abuts onto the inclined surface of the guiding rib 745. As shown in FIG. 22, further rightward movement of the recording material cutting device 730 causes the guiding roller 742 to be rotated and raised along the inclined surface, to thereby gradually lift up the whole of the cutter slider 740 including the cutter blade 750. When the guiding roller 742 reaches near the top of the guiding rib 745, the hooking members 740*a* are brought to hook to the members 743*a* so that the cutter slider 740 is again held at the upper position within the holder 743 against the downward (direction F) urging force by the spring 741.

Figure 25:
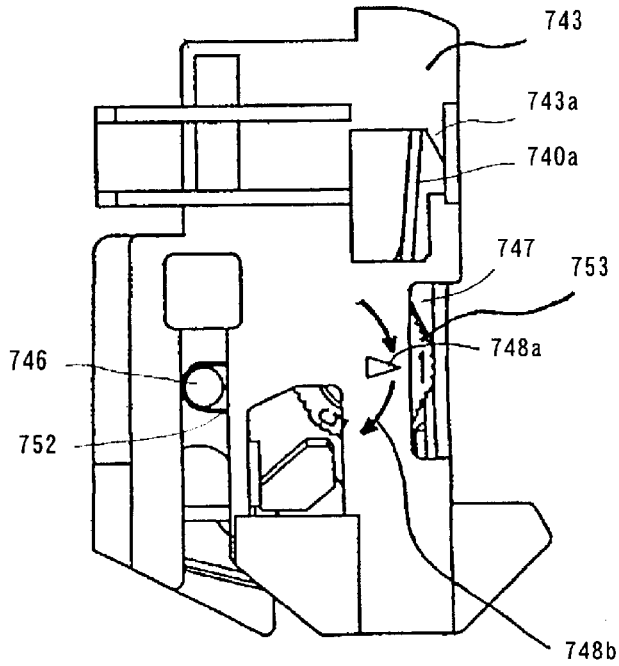
FIG. 25 is a rear view of the recording material cutting device shown in FIG. 24.
Figure 26:
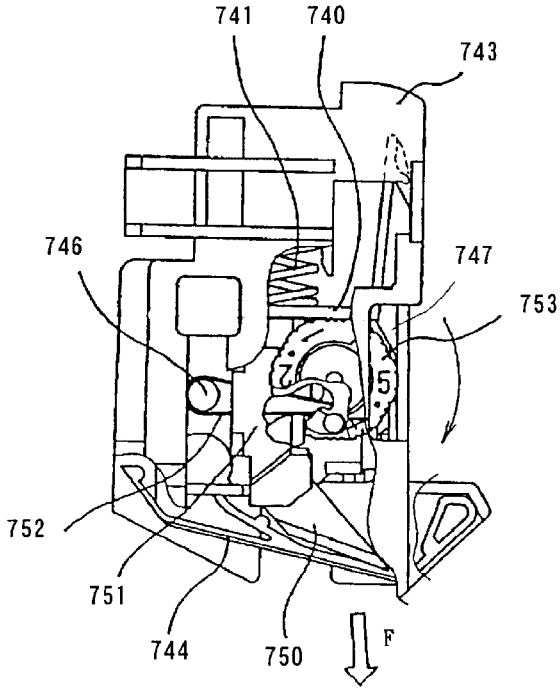
FIG. 26 is a partially cut-away view of the holder shown in FIG. 25, for explaining the inner structure of the holder.
Figure 29:
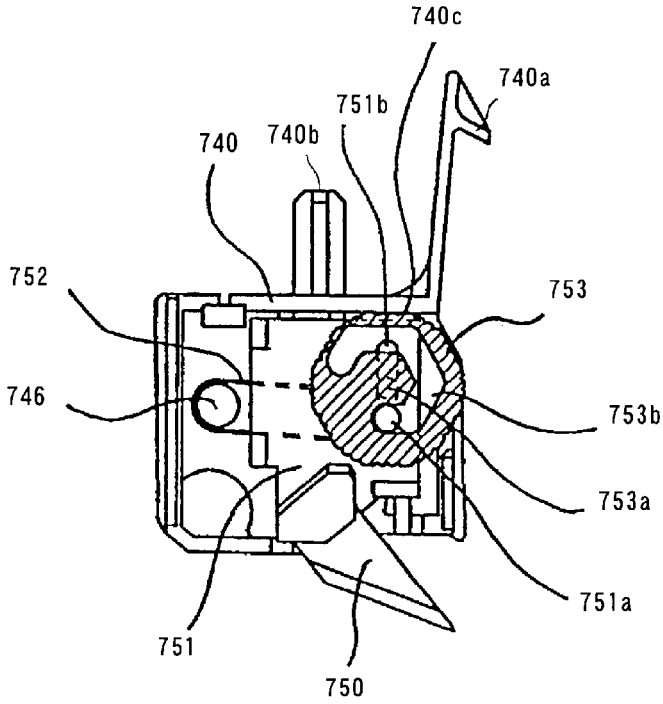
FIG. 29 is a view showing a state where the interior unit is taken out from the holder so as to section a disc-like dial at a central portion in a thickness direction of the dial along a plane parallelly to the obverse and reverse faces of the dial.
Figure 30:
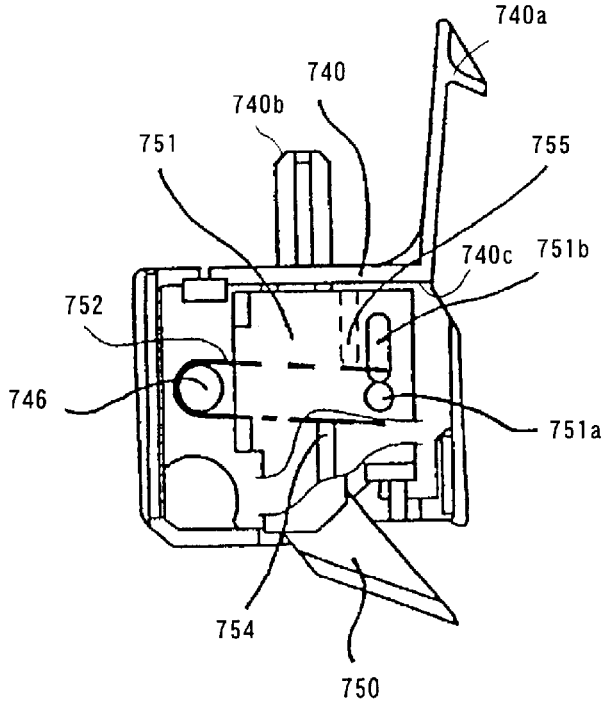
FIG. 30 is a view showing a state where the interior unit is taken out from the holder to detach the dial from the interior unit and to partly cut away a blade slider 751.
Figure 31:
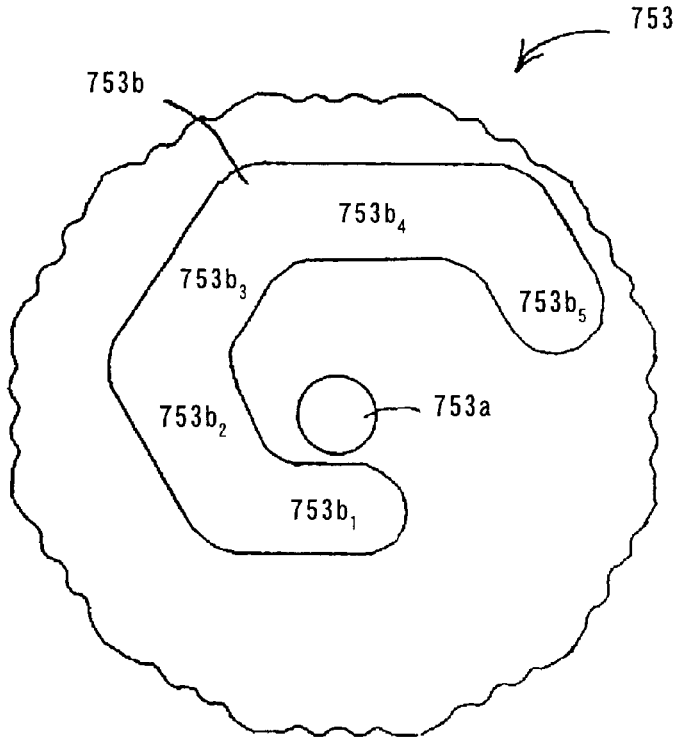
FIG. 31 is a view showing a reverse side of the dial.

There will be described hereinafter the way to adjust the protruding amount of the cutter blade 750 with reference to FIGS. 25 through 31. FIG. 25 is a rear view of the recording material cutting device 730 shown in FIG. 24, and FIG. 26 is a partially cut-away view of the holder shown in FIG. 25, for explaining the inner structure of the holder. FIGS. 27 through 30 are views of a unit (hereinafter called "interior unit") taken out from the interior of the holder 743. FIG. 29 is a view showing a state where a disc-like dial 753 is sectioned at a central portion in a thickness direction of the dial along a plane parallelly to the obverse and reverse faces of the dial, FIG. 30 is a view showing a state where the dial 753 is detached from the interior unit while partly cutting away a blade slider 751, and FIG. 31 is a view showing a reverse side of the dial 753.

As shown in FIGS. 27 through 30, the aforementioned interior unit comprises: the cutter slider 740; the blade slider 751 mounted with the cutter blade 750; the leaf spring 752 of a U-shape; and the dial 753 for adjusting the vertical position of the blade slider 751 within the cutter slider 740.

As shown in FIG. 30, provided within the cutter slider 740 is a boss 746 protruding in the reverse-to-obverse direction of the drawing plane, and the U-shape leaf spring 752 is mounted such that the boss 746 comes inside the bent portion of the U-shape. So as to cover them from the above, the blade slider 751 is accommodated into the cutter slider 740. At this time, both ends of the leaf spring 752 tending to expand outwardly (up-and-down direction in FIG. 30) are interposed between: a projection 754 provided at the cutter slider 740 in the reverse-to-obverse direction of FIG. 30; and a projection 755 provided at the reverse side of the blade slider 751 in the obverse-to-reverse direction in FIG. 30. Mounting the blade slider 751 in this way causes the blade slider 751 to be upwardly urged within the cutter slider 740 by the U-shaped leaf spring 752 tending to expand outwardly.

As shown in FIG. 30, the blade slider 751 is further provided with: a boss 751*a* protruding in the reverse-to-obverse direction of the drawing plane; and a vertically elongated through-hole 751*b*.

Figure 27:
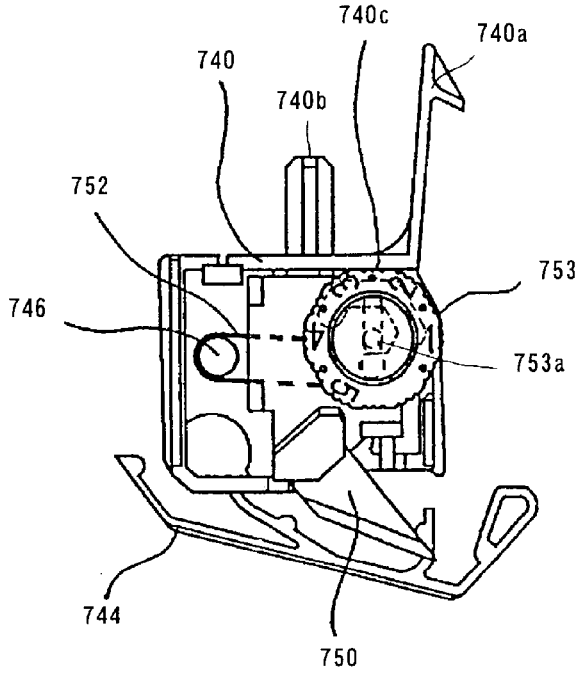
FIG. 27 is a view of an interior unit taken out from the holder.
Figure 28:
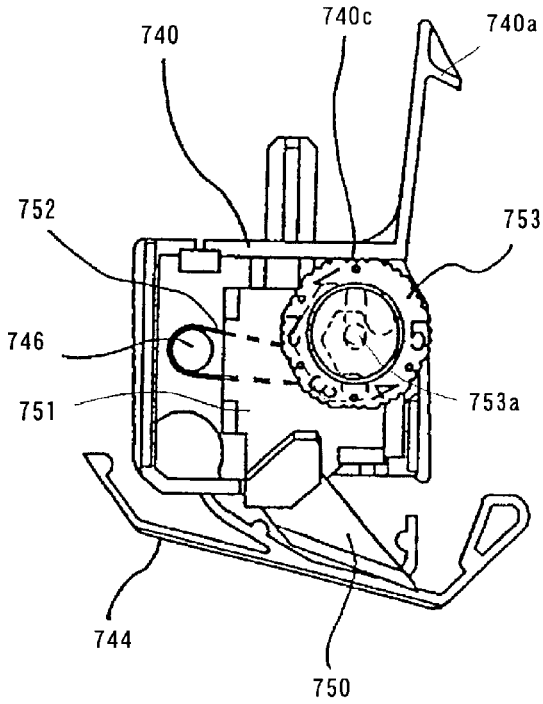
FIG. 28 is a view of the interior unit taken out from the holder.

As shown in FIGS. 27 and 28, the disc-like dial 753 is inscribed with numbers from "1" to "5", along the circumference at the obverse side of the disc-like dial 753. As shown in FIG. 31, the reverse side of the dial 753 is provided with: a central shaft 753*a* protruding in the reverse-to-obverse direction in FIG. 31; and a groove 753*b* formed by cutting out the surface of the reverse side of the dial 753. The groove 753*b* comprises five straight portions 753*b*, through 753$b_5$ which continuously bend to thereby surround the central shaft 753*a*. The distances of the straight portions 753*b*, through 753$b_5$ from the central shaft 753*a* are stepwise increased in this order. Further, the width of each of the straight portions 753*b*, through 753$b_5$ is set at a dimension for allowing the aforementioned boss 751*a* to be just inserted.

In mounting the dial 753 into the cutter slider 740, the central shaft 753*a* at the reverse side of the dial 753 is inserted into the through-hole 751*b* of the blade slider 751 shown in FIG. 30, and the boss 751*a* of the blade slider 751 is inserted into the groove 753*b* at the reverse side of the dial 753. As described above, the leaf spring 752 upwardly urges the blade slider 751, so that the dial 753 is urged upwardly via boss 751*a* provided at the blade slider 751 and via groove 753*b* inserted with the boss 751*a*. This presses the upper portion of the dial 753 against an upper portion 740*c* within the cutter slider 740.

The thus assembled interior unit is housed in the holder 743, by inserting the unit from the lower end portion of the holder 743 such that the elongated projection 740*b* upwardly provided at the upper portion of the cutter slider 740 is inserted into the lower end portion of the spring 741. The thus completed recording material cutting device 730 is mounted onto the carriage 721 by the aforementioned procedure.

When the interior unit has been housed within the holder 743, as shown in FIGS. 25 and 26, either of the numbers from "1" to "5" inscribed at the circumference of the obverse side of the dial 753 becomes visible via dial window 747 provided at the side portion of the holder 743. As shown in FIG. 25, the holder 743 is inscribed with, near the dial window 747: an arrow 748*a* for pointing that number of dial 753 which is visible via dial window 747; and an arrow 748*b* for pointing the turning direction of the dial 753. The arrow 748*a* points the number "1" of the dial 753 in FIG. 25, and the number "5" of the dial 753 in FIG. 26.

Users are allowed to rotate the dial by manually touching the circumference of the dial 753 exposed via dial window 747. Note, the dial 753 is exposed via dial window 747, only during the stand-by period where the hooking members 740*a* are hooked to the members 743*a* so that the cutter slider 740 is held at the upper position within the holder 743. During the cutting motion where the hooking members 740*a* are disengaged from the members 743*a*, it is impossible to rotate the dial 753.

Note, based on the reasons to be described later, the direction for rotating the dial 753 shall be limited, in the embodiment 7, to the direction indicated by the arrow 748*b* (clockwise direction in FIG. 25), i.e., the direction where the numbers visible via dial window 747 are increased.

The numbers from "1" to "5" inscribed at the circumference of the obverse side of the dial 753 correspond to those straight portions 753*b*, through 753$b_5$ of the groove 753*b* formed at the reverse side of the dial 753, respectively. Further, the straight portions 753*b*, through 753$b_5$ correspond to five steps of protruding amounts of the cutter blade 750, respectively.

In FIG. 29, the straight portion 753*b*, of the groove 753*b* of the dial 753 is located at the lowermost position, i.e., at the position of the boss 751*a* provided at the blade slider 751. At this time, the number visible via dial window 747 (i.e., the number pointed by the arrow 748*a*) is "1". This state is shown in FIG. 25 and FIG. 27. Conducting the cutting motion in this state leads to the minimum protruding amount of the cutter blade 750 downwardly from the cutter slider 740, so that the recording material 704 is cut by the tip portion of the cutter blade 750.

From this state, by rotating the dial 753 in the direction of the arrow 748*b* in FIG. 25 to thereby switch the number pointed by the arrow 748*a* to "2", the straight portion 753$b_2$ of the groove 753*b* of the dial 753 comes to the boss 751*a* provided at the blade slider 751. As described above, since the distance from the central shaft 753*a* to the straight portion 753$b_2$ is greater than the distance from the central shaft 753*a* to the straight portion 753$b_1$, the above switching: pushes down the boss 751*a*; yields the leaf spring 752 in the closing direction; moves down the blade slider 751 by one step; and increases the downward protruding amount of the cutter blade 750 upon the cutting motion.

Further from this state, by rotating the dial 753 in the direction of the arrow 748*b* in FIG. 25 to thereby increase the value of number pointed by the arrow 748*a*, the leaf spring 752 further yields in the closing direction and the blade slider 751 is gradually moved downwardly step by step. When the number pointed by the arrow 748*a* becomes "5", the blade slider 751 has been moved to the lowermost position so that the downward protruding amount of the cutter blade 750 becomes the maximum upon the cutting motion.

As the protruding amount of the cutter blade 750 upon the cutting motion is increased, the region of the cutter blade 750 for cutting the recording material 704 approaches the root of the cutter blade 750. Thus, by restricting the direction for rotating the dial 753 to the direction indicated by the arrow 748*b* as described above, the region of the cutter blade 750 for cutting the recording material 704 firstly set at the near-tip portion, and such a region for cutting the recording material 704 is gradually or stepwise moved toward the root of the cutter blade 750 each time the dial 753 is rotated by a user to thereby switch the number pointed by the arrow 748*a*.

In this way, by providing the mechanism for stepwise switching the protruding amount of the cutter blade 750 upon the cutting operation, it becomes possible to effectively use the whole edge surface of the cutter blade 750 by conducting the switching operation at intervals of appropriate periods, to thereby prolong the service life of the cutter blade and reduce the replacement frequency of cutter blades.

Further, in the recording material cutting device 730 of the embodiment 7, since the direction for rotating the dial 753 is restricted to the direction (clockwise direction in FIG. 25) indicated by the arrow 748*b* as described above, those portions of the edge surface of the cutter blade 750, which are downwardly protruded beyond the seizing member 744 upon the cutting operation, are to have been already used. Further, the unused portions of the edge surface of the cutter blade 750 are necessarily positioned above the seizing member 744. Thus, even when the cutting device happens to cause the cutter blade 750 to forcibly enter the recording material 704 such as in case that the recording material is buckled or bent due to the wear of the edge surface and/or an unexpected accident, the seizing member 744 prevents the deformed recording material from striking the unused portions of the cutter blade 750. Thus, the unused portions of the cutter blade 750 are never broken. Moreover, even if the used portions of the cutter blade are broken in such an accidental situation, the broken portions are never used thereafter to cut the recording material 704, thereby excluding the necessity for replacing the cutter blade 750 until the unused portions are exhausted, i.e., used up. This allows to keep using the cutter blade 750 up to its inherent service life.

Further, even those users unfamiliar with the usage of the recording material cutting device are allowed to assuredly switch the cutting region of the cutter blade 750 to the region to be used next, because the numbers from "1" to "5" are inscribed at the circumference of the dial 753 for switching the protruding amount of the cutter blade 750 upon the cutting operation, and because there are inscribed near the dial window 747 the arrow 748*a* for pointing the pertinent number of the dial 753 and the arrow 748*b* for pointing the rotating direction of the dial 753. This substantially avoids such mistakes that the cutter blade 750 is replaced while leaving the unused portions, and/or that the already used and worn portion of the cutter blade is used again to thereby bend and/or buckle the recording material 704.

In the recording material cutting device 730 of the embodiment 7, it is structurally possible to rotate the dial 753 in the direction opposite to the arrow 748*b*. In this regard, it is easy to adopt such a mechanism (so-called "one-way type") for inhibiting the dial 753 from being oppositely rotated, to thereby assuredly avoid the repeated usage of those used regions of the cutter blade. However, in such a mechanism, erroneously over-rotating the dial in case of switching to the due next number leads to failure of using those regions of the cutter blade corresponding to the skipped numbers, to thereby impose replacement of the cutter blade still having the unused portions.

As such, to allow to assuredly change over the cutting regions of the cutter blade in a correct order without complicating the mechanism, it is assumed to be desirable that the circumference of the dial 753 is inscribed or described with characters and marks such as numbers, and that the arrow 748*b* for indicating the rotating direction of the dial 753 is described at a position readily visible to users, like the recording material cutting device 730 of the embodiment 7. Of course, where it is allowed to adopt a mechanism complicated to a certain extent, it is possible to basically adopt the aforementioned one-way type and to additionally adopt such a mechanism: to permit only one step of switching by a single rotating motion; or to require two motions (actions) for one step of switching. This reduces, in a more assured manner, the risk of using again the used regions of the cutter blade to thereby cause the recording material to be bent and/or buckled. This also enables to use the regions of the cutter blade in the correct order. Such mechanisms are included in the technical scope recited in pertinent claims.

Meanwhile, the cutter blade 750 is allowed to be used in a manner to fulfill its inherent service life in the recording material cutting device 730 of the embodiment 7 as described above, by rotating the dial 753 in the particular direction to thereby change over the cutting region of the cutter blade in the predetermined order from the near-tip portion toward the near-root portion. However, if the cutting region of the cutter blade is newly changed over by the dial 753 and the new region which is one point of the cutter blade is then kept used, this cutting region is immediately abraded to thereby require the operation for again changing over the cutting region in a short time. This results in the shortened service life of the cutter blade 750.

As such, the embodiment 7 is constituted to cut the recording material concerning the respective switchable regions of the cutter blade, not by only one point of the cutter blade but by a certain width of the pertinent region. This will be described hereinafter.

Figure 32:
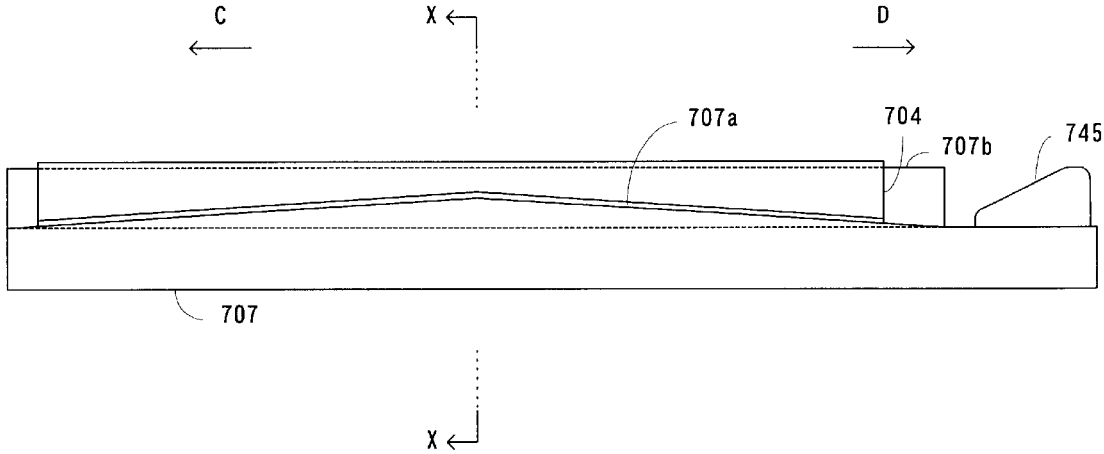
FIG. 32 is a view showing a state of a platen of the plotter when viewed from the downstream side of FIG. 18.
Figure 33:
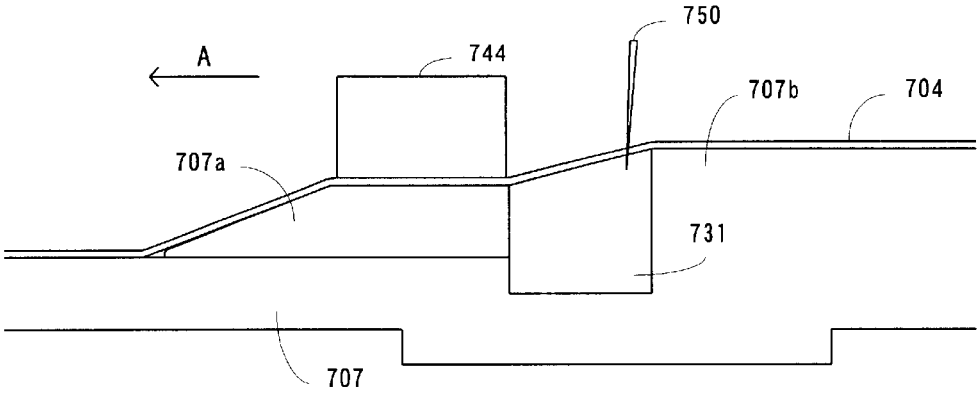
FIG. 33 is an X—X cross-sectional view of the platen shown in FIG. 32.

FIG. 32 is a view showing a state of the platen 707 of the plotter 701 when viewed from the downstream side of the recording material transferring direction of FIG. 18, and FIG. 33 is an X—X cross-sectional view of the platen 707 shown in FIG. 32. As shown in FIG. 33, the cutter-aimed groove 731 provided at the platen 707 is interposed between the downstream side cammed portion 707*a* and the upstream side wall 707*b*. As shown in FIG. 32, although the upstream side wall 707*b* is flat, the downstream side cammed portion 707*a* is formed to be high at the central portion and low at the opposite ends along the traveling direction (direction C or direction D) of the carriage 721. Note, in FIG. 32, the cammed portion 707*a* is exaggerated as compared with the actual configuration, to further clarify the height difference of the cammed portion 707*a*. In the actual device, the height difference of the cammed portion 707*a* is on the order of 0.8 mm when the width of the recording material 704 is 1,000 mm.

As shown in FIG. 33, the seizing member 744 seizes the recording material 704 onto the cammed portion 707*a*, while cutting the recording material 704. At this time, since the bump portion 744*a* of the seizing member 744 abuts onto the lower end portion of the cutter slider 740 (see FIG. 20) as described above, the up-and-down movement of the seizing member 744 along the cammed portion 707*a* causes the cutter blade 750 to upwardly and downwardly move simultaneously therewith.

Namely, in conducting the cutting motion, as the recording material cutting device 730 travels from the left end toward the central portion in FIG. 32, the height of the cammed portion 707*a* is gradually increased to thereby lift up the cutter blade 750, thereby correspondingly shallowing the cutting-in amount of the cutter blade 750 into the cutter-aimed groove 731. Simultaneously therewith, that region of the cutter blade 750 for cutting the recording material 704 is gradually shifted toward the tip end. Thereafter, as the recording material cutting device 730 travels toward the right end after passing over the central portion, the height of the cammed portion 707*a* is gradually reduced to thereby lower the position of the cutter blade 750, thereby increasing the cutting-in depth of the cutter blade 750 into the cutter-aimed groove 731. Thus, that region of the cutter blade for cutting the recording material 704 is gradually shifted toward the root.

Figure 34:
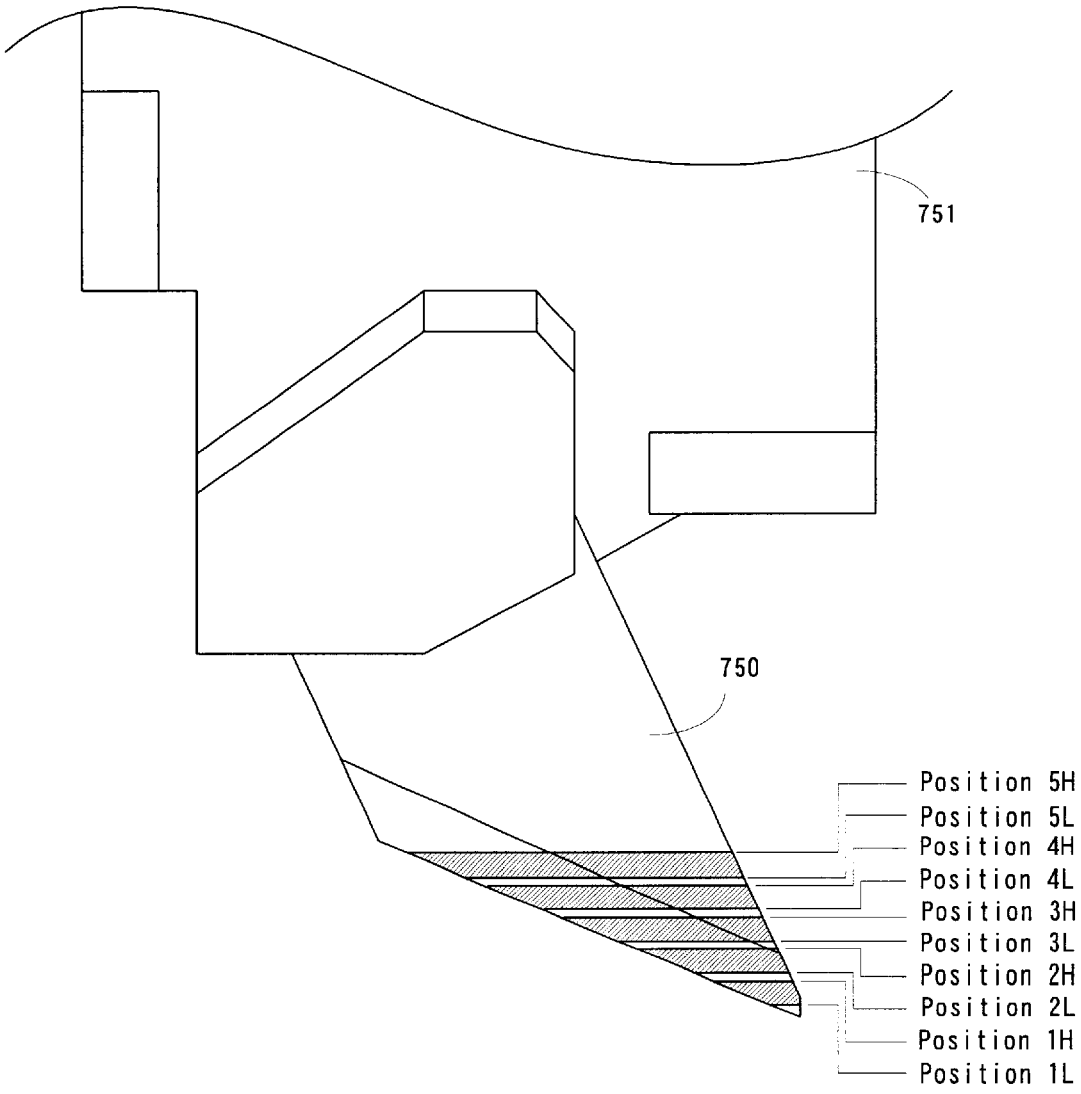
FIG. 34 is a view showing a way as to how a recording-material cutting region of a cutter blade is changed correspondingly to a changeover motion of a protruding amount of the cutter blade and to a traveling motion of the cutter blade along a cammed portion.
Figure 35:
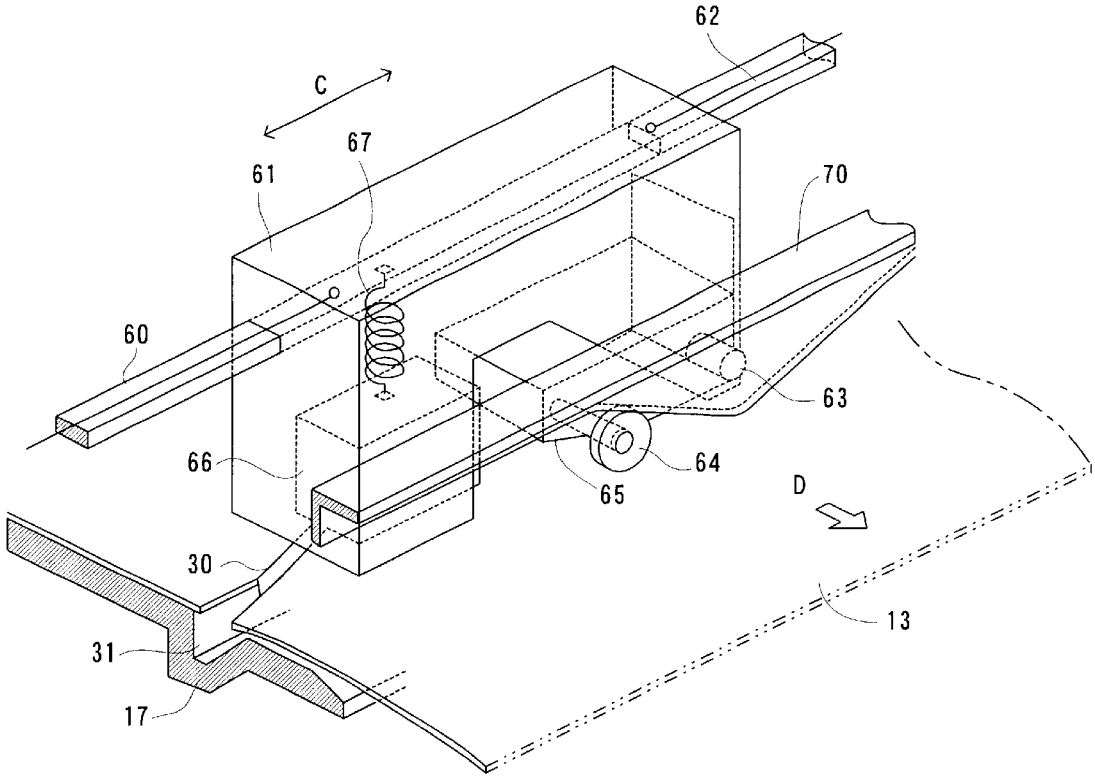
FIG. 35 is a perspective view showing an example of a conventional recording material cutting device.
Figure 36:
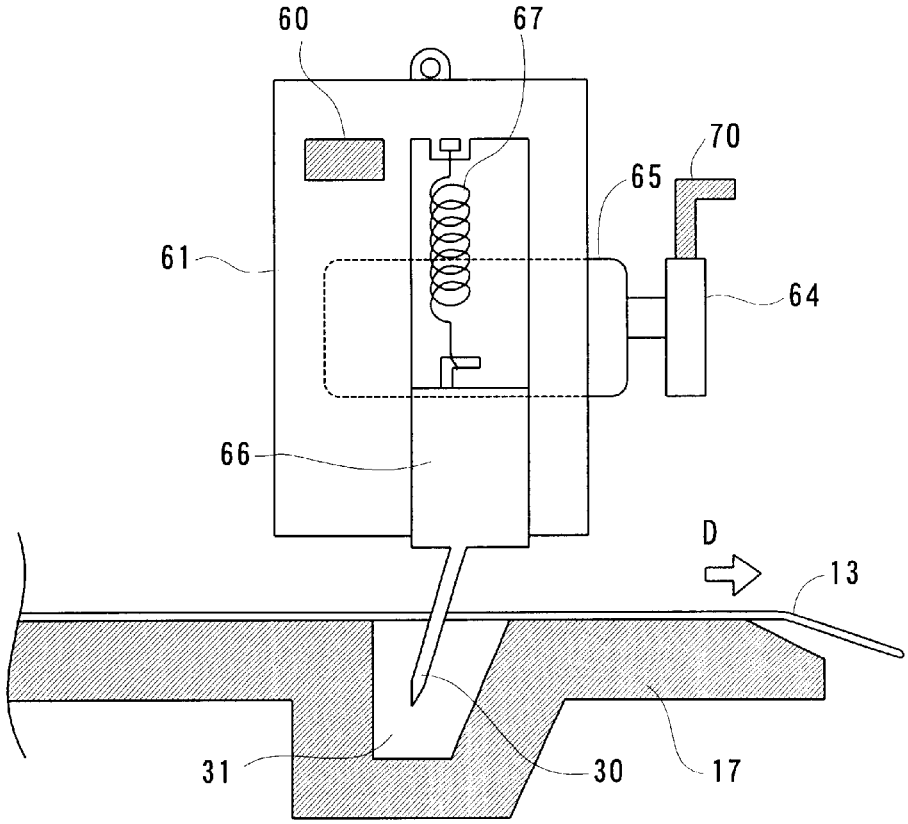
FIG. 36 is a cross-sectional view of the cutter blade portion of the device of FIG. 35 taken along a cross section including a straight line parallel to the recording material transferring direction.

FIG. 34 is a view showing a way as to how the cutting region of the cutter blade 750 for the recording material 704 is changed correspondingly to the changeover motion of the protruding amount of the cutter blade 750 as described above and to the traveling motion of the cutter blade 750 along the cammed portion 707*a*.

As described above, when that number (pointed by the arrow 748*a*) of the dial 753 which is visible via dial window 747 is "1", the protruding amount of the cutter blade 750 is the minimum so that the recording material 704 is cut by the most near-tip portion of the cutter blade 750. This region corresponds a cutting-position 1 in FIG. 34. Similarly, the numbers "2", "3", "4" and "5" of the dial correspond to cutting-positions 2,3,4 and 5, respectively. As the recording material cutting device 730 travels in the left-to-right direction along the cammed portion 707*a* in FIG. 32, the cutting-in amount of the cutter blade 750 into the cutter-aimed groove 731 is changed as described above, so that the cutting region is changed even for the same cutting-position.

For example, when the number of the dial 753 is set at the number "1" to thereby select the cutting-position 1, the recording material 704 is firstly cut by the highest (nearest to the root) cutting-position 1H in the region of the cutting-position 1. As the recording material cutting device 730 travels rightwardly, the cutting region is gradually shifted downwardly within the cutting-position 1, so that the recording material is cut by the lowest (nearest to the tip end) cutting-position 1L in the region of the cutting-position 1, at the central portion of the cammed portion 707*a*. Thereafter, as the recording material cutting device 730 further travels rightwardly, the cutting region is gradually shifted upwardly within the cutting-position 1, so that the recording material is again cut by the highest cutting-position 1H at the rightmost portion of the cammed portion 707*a*. As described above, since the height difference of the cammed portion 707*a* is set at about 0.8 mm, the height difference between the cutting-position 1H and cutting-position 1L is also set at about 0.8 mm. The same rule applies correspondingly to the other cutting-positions 2 through 5.

In FIG. 34, neighboring two cutting-positions have not been mutually overlapped at all. However, it is possible to slightly overlap neighboring two cutting-positions each other, in the following situation.

It is most likely for a recording material to be bent or buckled, upon breaking into the recording material where the cutter blade impinges on the side end portion of the recording material at a substantially right angle. Contrary, once the cutter blade has successfully entered the recording material to thereby start cutting, it is less likely for the recording material to be bent or buckled even when the cutting quality of the cutter blade is deteriorated more or less. Thus, there is required the best cutting quality at the time when the cutter breaks into the recording paper, upon cutting the recording material.

Thus, by adopting such a design as shown in FIG. 34 that the cutting-position is sequentially or stepwise changed over in the direction from the tip end toward the root of the cutter blade 750 and that the cutting is started from the near-root portion (for example, 1H in the cutting-position 1) in the same cutting-position, that (less used) region of the cutter blade upon breaking into the recording material is always allowed to keep the best cutting quality within the region of the pertinent cutting-position even if neighboring two cutting-positions are slightly overlapped each other. In such a situation, it is allowed to mutually overlap those neighboring two cutting-positions more or less.

This enables to prevent the respective portions of the cutter blade from being unused, to thereby allow to effectively use the cutter blade. Still more, mutually overlapping neighboring two cutting-positions permits to increase the number of cutting-positions shown in FIG. 34, thereby allowing to further prolong the service life of the cutter blade.

In the above, the shape of the cammed portion 707*a* has been formed to be high at the central portion and low at the starting point side and ending point side. However, it is possible to form the cammed surface such that one and the other of the starting point and ending point are high and low, respectively, to thereby form a simply tapered shape, or such that the high and low portions are repeated several times between the starting point and the ending point.

The present invention has been described concerning the embodiments thereof. However, the present invention is not limited to the above embodiments, and may be of course variously modified within the spirit of the invention defined in the accompanying claims, and such modifications are also embraced within the pertinent technical scope of the invention.

INDUSTRIAL APPLICABILITY

As described above, the present invention can be applied to recording material cutting devices to be used in an ink-jet recording device and color plotter such as exemplified in the section of "BEST MODE FOR CARRYING OUT THE INVENTION", and in various image-forming apparatus such as a printer, facsimile and copying machine, and can be particularly applied to recording material cutting devices to be preferably utilized in an image-forming apparatus capable of forming an image on a recording material of a large length.

What is claimed is:

1. A recording material cutting device including a cutter blade having a substantially straight edge for cutting a recording material by traveling the cutter blade in a direction substantially perpendicular to a recording material transferring direction, the recording material being transferred on a recording material placing part of an image-forming apparatus, said recording material cutting device comprising:

cutter blade fixing means fixedly mounted with said cutter blade;

urging means for resiliently urging said cutter blade fixing means in the direction toward said recording material placing part;

cutter blade traveling means for traveling, upon the cutting motion, said cutter blade fixing means together with said urging means in the direction substantially perpendicular to said recording material transferring direction and in parallel to said recording material placing part;

a cammed surface having an upward and downward variation in height above said recording material placing part, and being formed at that portion of said recording material placing part, which is along the traveling path of said cutter blade; and recording material seizing means provided integrally with said cutter blade fixing means, so as to resiliently receive the urging force of said urging means in a state of clamping the recording material between said recording material seizing means and said cammed surface upon the cutting motion, to thereby seize the recording material;

wherein said recording material seizing means is moved in a state where said recording material seizing means is urged toward said cammed surface with the recording material therebetween upon traveling of said cutter blade fixing means, so that said cutter blade is moved upward and downward to thereby cut the recording material.

2. A recording material cutting device of claim 1, wherein said cutter blade is fixed such that the side surface of said cutter blade is inclined from the direction in which said cutter blade fixing means is urged, and wherein said urging means urges said cutter blade fixing means in the direction perpendicular to said recording material placing part.

3. A recording material cutting device of claim 1, wherein said cutter blade is fixed such that the side surface of said cutter blade is parallel to the direction in which said cutter blade fixing means is urged, and wherein said urging means urges said cutter blade fixing means in the direction inclined from the direction perpendicular to said recording material placing part.

4. A recording material cutting device of claim 1, wherein the cammed surface has a center portion and end portions, the center portion having a height above said recording material placing part greater than that of the end portions.

5. A recording material cutting device of claim 1, wherein the cammed surface has a first end portion at one end and a second end portion at another end, the first end portion having a height above said recording material placing part greater than that of the second end portion.

* * * * *